US007015652B2

(12) United States Patent
Shi

(10) Patent No.: US 7,015,652 B2
(45) Date of Patent: Mar. 21, 2006

(54) ELECTRONIC BALLAST HAVING END OF LAMP LIFE, OVERHEATING, AND SHUT DOWN PROTECTIONS, AND REIGNITION AND MULTIPLE STRIKING CAPABILITIES

(75) Inventor: Ruhe Shi, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 10/688,507

(22) Filed: Oct. 17, 2003

(65) Prior Publication Data

US 2005/0093477 A1 May 5, 2005

(51) Int. Cl.
*H05B 37/00* (2006.01)

(52) U.S. Cl. ..... 315/224; 315/307

(58) Field of Classification Search ..... 315/224, 315/225, 291, 307, 308, 219, 244, 209 CD, 315/209 R, 247
See application file for complete search history.

(56) References Cited

U.S. PATENT DOCUMENTS

| | | | | |
|---|---|---|---|---|
| 4,354,181 | A | 10/1982 | Spletzer | 340/642 |
| 5,363,020 | A | 11/1994 | Chen et al. | 315/209 |
| 5,436,529 | A | 7/1995 | Bobel | 315/127 |
| 5,449,981 | A | 9/1995 | Auld, Jr. et al. | 315/308 |
| 5,493,180 | A | 2/1996 | Bezdon et al. | 315/91 |
| 5,500,576 | A | 3/1996 | Russell et al. | 315/307 |
| 5,623,187 | A | 4/1997 | Caldeira et al. | 315/307 |
| 5,636,111 | A | 6/1997 | Griffin et al. | 363/37 |
| 5,770,925 | A | 6/1998 | Konopka et al. | 315/225 |
| 5,925,990 | A | 7/1999 | Crouse et al. | 315/307 |
| 5,945,788 | A | 8/1999 | Li et al. | 315/308 |
| 5,969,483 | A | 10/1999 | Li et al. | 315/225 |
| 5,982,106 | A | 11/1999 | Bobel | 315/209 |
| 6,111,363 | A | 8/2000 | Nerone | 315/225 |
| 6,127,786 | A | 10/2000 | Moisin | 315/291 |
| 6,169,369 | B1 | 1/2001 | Nerone et al. | 315/106 |
| 6,211,623 | B1 | 4/2001 | Wilhelm et al. | 315/224 |
| 6,215,255 | B1 | 4/2001 | Kim et al. | 315/291 |
| 6,316,887 | B1 | 11/2001 | Ribarich et al. | 315/307 |
| 6,362,575 | B1 * | 3/2002 | Chang et al. | 315/224 |
| 6,366,032 | B1 * | 4/2002 | Allison et al. | 315/307 |
| 6,420,838 | B1 | 7/2002 | Shackle | 315/224 |
| 6,429,603 | B1 * | 8/2002 | Tsugita et al. | 315/224 |
| 6,501,225 | B1 | 12/2002 | Konopka | 315/105 |
| 6,552,494 | B1 | 4/2003 | Randazzo et al. | 315/106 |
| 2002/0105283 | A1 | 8/2002 | Murakami et al. | 315/224 |
| 2003/0025464 | A1 | 2/2003 | Konopka | 315/291 |

OTHER PUBLICATIONS

European Patent Application No.: 93110047.3, Jan. 5, 1994.
European Patent Application No. 82102521.0, Oct. 6, 1982.

* cited by examiner

*Primary Examiner*—Wilson Lee
(74) *Attorney, Agent, or Firm*—Waddey & Patterson, P.C.; Larry W. Brantley; Howard H. Bayless

(57) ABSTRACT

An electronic ballast having end of lamp life and overheating protection, and automatic reignition and multiple striking capabilities includes AC/DC rectifier, PFC/boost, inverter, and ballast protection and control circuits. The ballast protection and control circuit is operable to place the ballast in a protected state when the lamp load connected to the ballast reaches an end of lamp life condition or the ballast overheats. The ballast protection and control circuit also automatically ignites the lamp load when it is connected to the ballast and generates multiple striking attempts for hard to strike lamp loads. The ballast may be connected to AC or DC power sources and different types of lamp loads, and may include various different types of inverter circuits.

11 Claims, 17 Drawing Sheets

AC/DC Rectifier Circuit 20

PFC/Boost Circuit 30

Inverter Circuit 40

Ballast Protection And Control Circuit 50

Upper Portion Of Reignition Circuit 140

Lower Portion Of Reignition Circuit 140

Multiple Striking Circuit 150

ELECTRONIC BALLAST HAVING END OF LAMP LIFE, OVERHEATING, AND SHUT DOWN PROTECTIONS, AND REIGNITION AND MULTIPLE STRIKING CAPABILITIES

A portion of the disclosure of this patent document contains material that is subject to copyright protection. The copyright owner has no objection to the facsimile reproduction by anyone of the patent document or the patent disclosure, as it appears in the Patent and Trademark office patent file or records, but otherwise reserves all copyright rights whatsoever.

Be it known that I, Ruhe Shi, a citizen of China, residing at 150 Liberty Drive, Madision, Ala. 35758, have invented a new and useful "Electronic Ballast Having End Of Lamp Life, Overheating, and Shut Down Protections, And Reignition And Multiple Striking Capabilities."

BACKGROUND OF THE INVENTION

The present invention relates generally to electronic ballasts for gas discharge lamps.

More particularly, this invention pertains to an electronic ballast that includes end of lamp life protection, overheating protection, automatic shut-down protection capabilities, reignition capabilities, and multiple striking capabilities.

Electronic ballasts for gas discharge lamps are well known in the art and include a variety of different types of protection features and capabilities. For example, the prior art includes electronic ballasts that include end of lamp life protection circuits that are designed to protect the electronic ballast and the gas discharge lamp from being damaged by an end of lamp life condition. The prior art includes electronic ballasts having overheating protection circuits that are designed to protect a ballast from being damaged by excessive heating conditions. The prior art also includes electronic ballasts that include reignition circuits that are designed to automatically ignite a gas discharge lamp when it is reconnected to the electronic ballast. In addition, the prior art includes electronic ballasts that include multiple striking circuits that are designed to generate multiple striking attempts that can be used to ignite cold, new, or old gas discharge lamps that can be difficult to ignite with an otherwise single strike.

An end of lamp life condition is a condition that occurs when a gas discharge lamp reaches the end of its effective operating lifetime. When this occurs, as an instance, the gas discharge lamp can begin to rectify the AC current applied to the gas discharge lamp. The gas discharge lamp can rectify current in a positive direction, commonly referred to as positive rectification, or in a negative direction, generally referred to as negative rectification. Regardless of the direction of rectification, the rectification causes the peak to peak voltage across the gas discharge lamp to gradually increase and, as a result, the power drawn by the gas discharge lamp and thus the ballast. This is an undesirable condition because the ballast is usually very sensitive to the increased power it has to deliver to the lamp and it will be overheated and eventually destroyed by this increased power. Similarly, this situation can cause damage to the gas discharge lamp. In addition, an end of lamp life condition can also cause the peak to peak voltage across the gas discharge lamp to increase symmetrically. Once again, the increasing voltage causes the power drawn by the gas discharge lamp and thus the ballast to increase and this can damage both the electronic ballast and the gas discharge lamp.

The end of lamp life protection circuits in the prior art are designed to sense an end of lamp life condition in a gas discharge lamp and to compensate for this condition before the electronic ballast or the gas discharge lamp can be damaged by the various end of lamp life conditions that can occur. Typically, the protection circuits are designed to command the electronic ballast to simply shut down completely. Alternatively, the protection circuits can cause the electronic ballast to reduce the power delivered to the gas discharge lamp to a safe level that will not damage the electronic ballast or the gas discharge lamp.

An overheating condition typically occurs when consumers improperly install electronic ballasts in areas where they cannot be properly cooled. As a result, these electronic ballasts overheat and eventually fail, resulting in customer dissatisfaction and increased customer costs. Overheating protection circuits are designed to sense and compensate for this type of condition before the electronic ballast or the gas discharge lamp can be damaged by excessive heat. As was the case with end of lamp life protection circuits, overheating protection circuits may command an electronic ballast to shut down completely or to reduce the power delivered to the gas discharge lamp to a safe level so that the ballast will not be damaged by excessive heat.

Examples of electronic ballasts including end of lamp life protection circuits, overheating protection circuits, automatic reignition circuits, and multiple striking circuits are described in U.S. Pat. No. 6,420,838, issued to Shackle on Jul. 26, 2002 and entitled "Fluorescent lamp ballast with integrated circuit," U.S. Pat. No. 6,366,032, issued to Allison, et al. on Apr. 2, 2002 and entitled "Fluorescent lamp ballast with integrated circuit," and U.S. Pat. No. 5,925,990, issued to Crouse et al. on Jul. 20, 1999 and entitled "Microprocessor controlled electronic ballast."

Although the prior art does appear to teach several different types of a protection circuits for electronic ballasts, these circuits have several disadvantages. For example, end of lamp life protection circuits taught by the prior art must be designed to handle very high currents and, as a result, dissipate large amounts of power. This makes these types of protection circuits fairly inefficient. In addition, many prior art end of lamp life protection circuits sense DC rectification end of lamp life conditions or excessively high AC end of lamp life conditions, but not both. Known overheating protection circuits suffer from an inability to accurately sense when an overheating condition has occurred and, consequently, do not provide adequate overheating protection. Prior art reignition circuits can inadvertently attempt to reignite a lamp load even after a ballast has been shut down by another protection circuit.

In addition to the above-referenced disadvantages of prior art protection circuits, the applicant has also recognized that the prior art does not appear to teach one protection circuit that includes all of the desired protection and capabilities described above in an inexpensive, simple but reliable package. While prior art electronic ballasts do include end of lamp life protection circuits, overheating protection circuits, reignition circuits, multiple striking circuits, or some combination of these features, many of these prior art ballasts require expensive microprocessors or complicated circuits including a large number of component parts to accomplish each protection feature separately, both of which are very undesirable from the consumer and the manufacturer viewpoint.

What is needed, then, is an electronic ballast that includes end of lamp life protection, overheating protection, reignition capabilities, and multiple striking capabilities in an inexpensive, simple package and that overcomes the disadvantages of prior art electronic ballasts.

SUMMARY OF THE INVENTION

Accordingly, one object of the present invention is to provide an electronic ballast that includes end of lamp life protection, overheating protection, reignition capabilities, and multiple striking capabilities.

A second object is to provide a ballast end of lamp life protection circuit that is more efficient and consumes less power than prior art end of lamp life protection circuits.

Another object of the present invention is to provide an end of lamp life protection circuit that is designed to operate using lower currents than prior art end of lamp life protection circuits.

A fourth object is to provide an end of lamp life protection circuit that can sense both DC rectification and excessively high AC voltage end of lamp life conditions.

Another object is to provide an overheating protection circuit that can more accurately sense overheating conditions when compared to prior art overheating protection circuits.

A sixth object of the present invention is to provide a reignition circuit that does not inadvertently attempt to reignite a lamp load after a ballast has been shut down or placed in some other type of protected state.

Still another object is to provide an electronic ballast that provides all of the above-referenced features in an inexpensive, simple package.

These objects, and other objects that will become apparent to one skilled in the art practicing the present invention, are satisfied by the electronic ballast of the present invention. The electronic ballast includes an AC/DC rectifier circuit, a power factor correction (PFC)/Boost circuit, an inverter circuit having an output resonant circuit and a ballast protection and control circuit that is operable to provide end of lamp life protection, overheating protection, automatic reignition capabilities, and multiple striking capabilities.

The AC/DC rectifier circuit is designed to be connected to an AC power source, to receive an AC voltage from the AC power source, and to convert AC voltage into a relatively constant DC voltage. The PFC/Boost circuit is operable to boost the DC voltage generated by the AC/DC rectifier circuit to generate a boosted DC voltage and to ensure that the power factor of input AC line source remains above a desired high level.

The inverter circuit is operable to convert boosted DC voltage received from the PFC/Boost circuit into high frequency AC voltage that can be used to supply power to a gas discharge lamp load through the associated output resonant circuit. The ballast protection and control circuit senses the output lamp voltage and detects continuity of the lamp filaments, and is operable to provide end of lamp life protection, overheating protection, automatic reignition capabilities, and multiple striking capabilities.

The present invention of an electronic ballast may vary in a variety of different ways. For example, the electronic ballast of the present invention may be designed to be connected to a DC power source rather than an AC power source. In this type of embodiment, the AC/DC rectifier circuit is not necessary although it may still be used. Consequently, another object of the present invention is to provide an electronic ballast that can be connected to such a power source and that includes end of lamp life protection, overheating protection, automatic reignition capabilities, and multiple striking capabilities.

In other embodiments, the DC power source may be designed to provide power factor correction and boosting capabilities. In this case, the PFC/Boost circuit is not required. Thus, another object is to provide an electronic ballast that does not include a PFC/Boost circuit, but still provides the above-referenced protection features and capabilities.

The inverter circuit used with the present invention may also vary. In the preferred embodiment, the inverter circuit includes a half bridge transistor circuit and a series resonant output circuit. In other embodiments, a full bridge transistor circuit, push pull transistor circuit, and a parallel resonant output circuit may be used as well. The inverter circuit also includes an inverter or oscillator driver integrated chip that is operable to receive protection and capabilities control signals from the various circuits included in the ballast protection and control circuit and to generate inverter control signals that control the output of the inverter circuit based on those control signals. In alternative embodiments, the inverter driver integrated chip may be separated into two different chips, one to drive the half bridge transistor circuit and one to receive the protection and capabilities control signals and generate the transistor drive control signals. Accordingly, still another object of the present invention is to provide an electronic ballast that includes these variations as well.

The applicant further recognizes that, in some applications, it may be desirable to implement the electronic ballast without the full complement of protection features and capabilities. Thus, in some applications, the ballast protection and control circuit may include only the end of lamp life protection circuit or the overheating protection circuit of the present invention. In other embodiments, the ballast protection and control circuit may include only the reignition or the multiple striking capabilities. Consequently, yet another object of the present invention is to provide a ballast protection and control circuit that includes any combination of these four features and capabilities.

DESCRIPTION OF THE PREFERRED EMBODIMENTS

Figure 1:
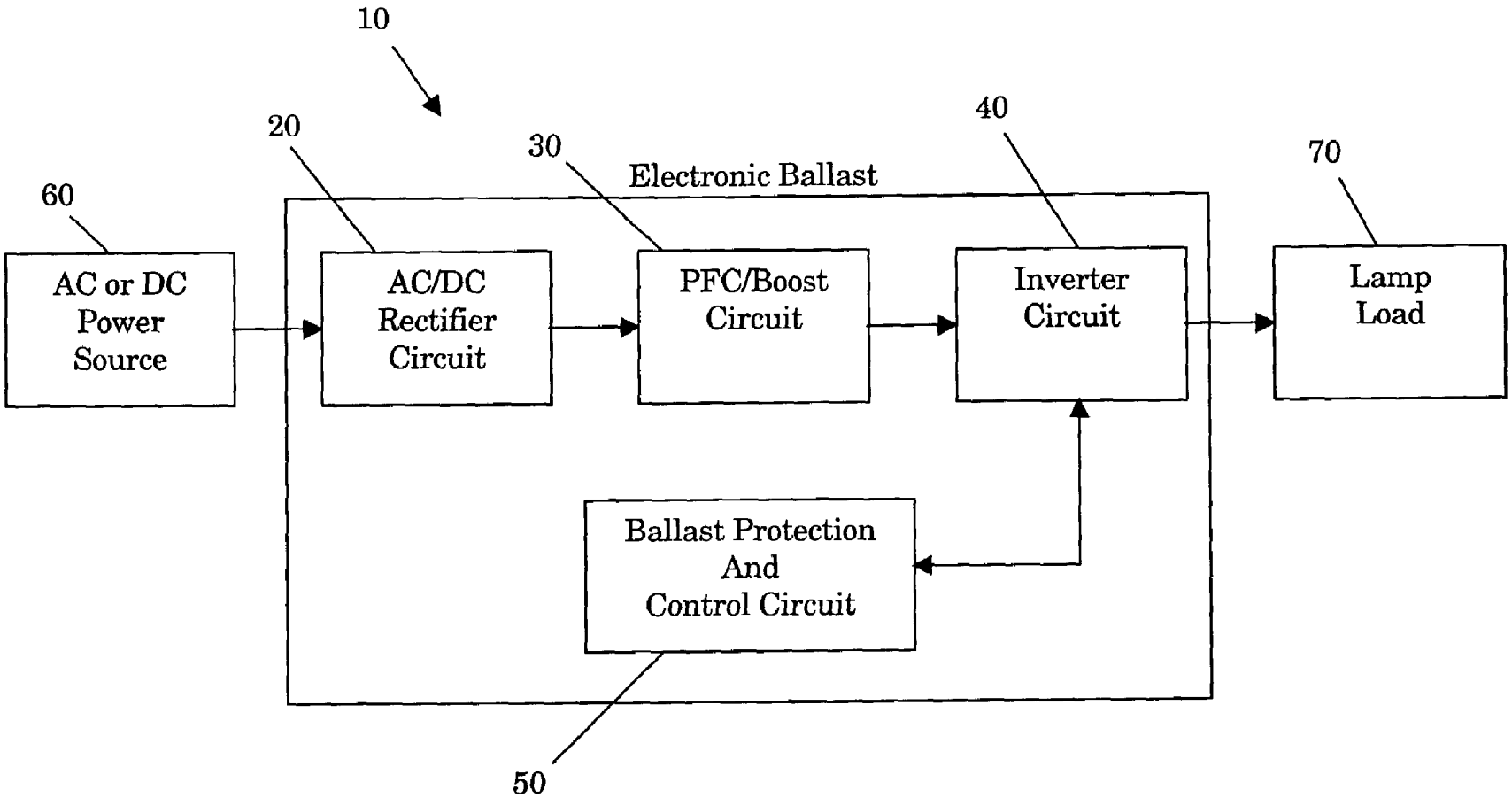
FIG. 1 is a block diagram showing a preferred embodiment of the present invention.

Referring to FIG. 1, one embodiment of the electronic ballast 10 of the present invention includes an AC/DC rectifier circuit 20 (the rectifier circuit 20), a power factor correction and boost circuit 30 (the PFC/boost circuit 30), an inverter circuit 40 having an associated output resonant circuit 100 (not shown in FIG. 1, but see FIG. 8), and a ballast protection and control circuit 50. The ballast 10 is operable to receive power from an AC or DC power source 60 and to supply power to a gas discharge lamp load 70.

The AC power source 60 is operable to supply AC voltage and current signals to the lamp load 70 through the electronic ballast 10. Any one of a variety of AC power sources known in the art may be used with the present invention. In a preferred embodiment, the AC power source 60 is simply a local electric utility company AC power source and is accessed using a common electrical outlet found in a typical home or business.

The AC/DC rectifier circuit 20 (see FIGS. 1 and 8*a*) and the PFC/boost circuit 30 are used to condition the AC voltage and current signals supplied by the AC power source 60 to the inverter circuit 40. The AC/DC rectifier circuit 20 (the rectifier circuit 20) is operable to convert a low frequency AC voltage signal, typically a 60-Hertz signal, from the AC power source 60 into a rectified, substantially constant, DC voltage signal that is used to drive the PFC/boost circuit 30. AC/DC rectifiers are well known in the art and any one of a variety of different types of rectifiers may be used with the present invention. For example, the prior art includes simple rectifiers that include a single diode, half bridge rectifiers that include two diodes, and full bridge rectifiers that include four diodes. Any one of these rectifiers may be used with the ballast 10 of the present invention.

The PFC/boost circuit 30 (see FIGS. 1 and 8*b*) is connected to the output of the rectifier circuit 20 and is operable to supply a boosted DC voltage to the inverter circuit 40 and to ensure that the power factor of input AC power source is above a desired level. In other words, the PFC/boost circuit 30 boosts the DC voltage signal supplied by the rectifier circuit 20 up to a desired boosted DC voltage level and ensures that the power factor of AC power supplied to the AC/DC rectifier circuit 20 remains above a desired level. As was the case with the rectifier circuit 20 discussed above, PFC/boost circuits are well known in the art and any one of a variety of different types of circuits may be used with the present invention.

It is important to note that the PFC/boost circuit 30 is optional and is only required when high open circuit voltage is needed to strike the lamp and the input power source voltage varies. In addition, in embodiments where a DC power source 80 (see FIG. 2) is used in place of the AC power source 60, the rectifier circuit 20 and the PFC/boost circuit 30 are not required at all. The DC power source 80, of course, should be capable of supplying the DC voltage and currents required by the inverter circuit 40 in order to eliminate the PFC/boost circuit 30.

The gas discharge lamp load 70 (the lamp load 70) includes one or more gas discharge lamps that operate using AC voltages and currents. Gas discharge lamps, such as fluorescent lamps, are well known in the art and any one of a variety of these lamps may be used with the present invention.

Regardless of whether an AC power source 60 or a DC power source 80 is used with the present invention, the ballast 10 also includes the inverter circuit 40 referenced above. The inverter circuit 40 (see FIGS. 1 and 8*c*) is operable to convert a DC voltage signal, supplied by either the DC power source 80 (see FIG. 2) or the PFC/boost circuit 30 (see FIG. 1), into a high frequency AC output voltage signal that is supplied to the lamp load 70.

Inverter circuits are well known in the art and any one of these known devices may be used with the present invention. For example, in a preferred embodiment, the inverter circuit 40 includes a half bridge transistor circuit 90 and a series resonant LC output circuit 100 (see FIGS. 8 and 8*c*). In other embodiments, a full bridge circuit (not shown), a push pull circuit (not shown), or a parallel resonant LC circuit (not shown) may be used as well.

In addition, the inverter circuit 40 in the preferred embodiment includes a half bridge inverter driver integrated chip 110 (see FIG. 8*c*) that is used to control the operation of the half bridge transistor circuit 90. The inverter driver integrated chip 110 provides this functionality by generating inverter control signals for the half bridge transistor circuit 90 based on protection control signals received from the ballast protection and control circuit 50.

In alternative embodiments, the half bridge inverter driver integrated chip 110 may be separated into two separate chips (not shown), one chip being used to generate drive control signals for the inverter half bridge transistor circuit 90 to control the oscillating frequency of the transistors, and the second microcontroller being used to receive protection and capabilities control signals from the ballast protection and control circuit 50 and to generate the drive control signals based on those signals.

Figure 2:
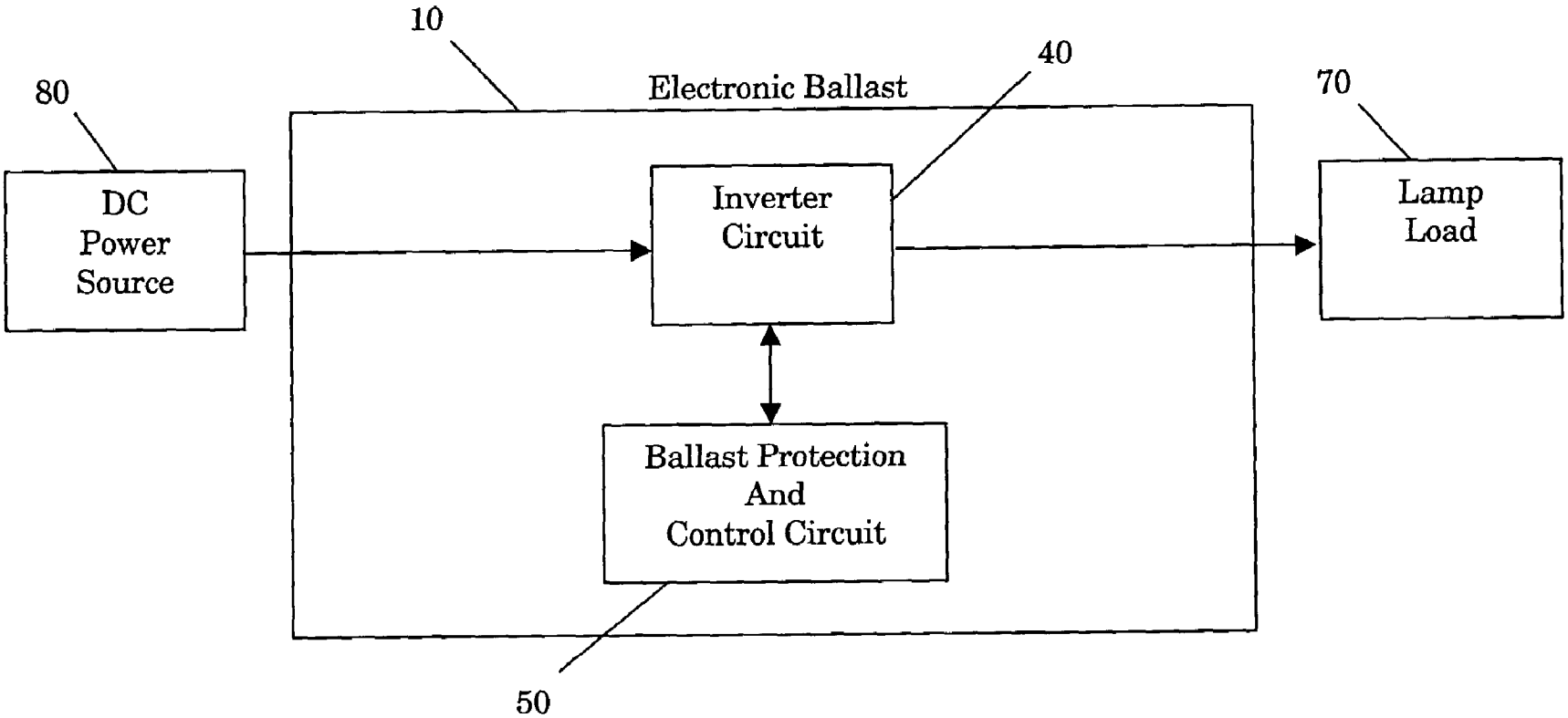
FIG. 2 is a block diagram of a second embodiment of the present invention designed to be connected to a DC power source.

Based on a review of FIGS. 1–2 and the above description, one skilled in the art will recognize that the ballast 10 includes several components that are typically included in prior art electronic ballasts that can be used to supply power to a lamp load. The primary difference between the ballast 10 of the present invention and the prior art is the ballast protection and control circuit 50 that is used to protect and control the ballast 10 and lamp load 70.

Referring again to FIGS. 1–2, the ballast protection and control circuit 50 (the ballast protection circuit 50) is capacitively coupled to the inverter circuit 40 and is operable to protect the inverter circuit 40 and lamp load 70 from being damaged by problems that typically occur during normal operations. For example, it is well known that a ballast may be damaged if a gas discharge lamp that has reached the end of its useful operating lifetime, generally referred to as an end of lamp life condition, is not quickly disconnected from the ballast.

The ballast protection circuit 50 (see FIGS. 1 and 8*d*) is operable to sense an end of lamp life condition in the lamp load 70 and to place the inverter circuit 40 in an end of lamp life protected state so that the end of lamp life condition does not damage the ballast 10 or the lamp load 70. The ballast 10 may be placed in a variety of different states that will protect the ballast 10 from an end of lamp life condition. For example, in a preferred embodiment, the ballast protection circuit 50 is operable to shut down the inverter circuit 40 in response to a sensed end of lamp life condition. In other embodiments, however, the ballast 10 may simply be placed in a protected state so that it supplies very little power to the lamp load 70 in response to a sensed end of lamp life condition. This is typically done by changing the oscillating frequency of the inverter circuit 40 in the ballast 10. Regardless of how this situation is handled, the important point is that the ballast protection circuit 50 places the ballast 10 in a protected state so that neither the ballast 10 nor the lamp load 70 can be damaged by the end of lamp life condition.

Another problem that could occur during normal operation of an electronic ballast is overheating. This typically occurs when a customer installs a ballast in a particular location and then improperly covers the ballast with insulation. As a result of the insulation, the ballast can overheat and fail due to excessive heat.

The ballast protection circuit 50 of the present invention is operable to sense when the ballast 10 is overheating and to place the ballast 10 into an overheating protected state, which may or may not be the same as the end of lamp life protected state discussed above, so that excessive heat does not damage the ballast 10. As before with the end of lamp life condition, the ballast 10 may be placed in a variety of different states that will protect the ballast 10 from overheating. In a preferred embodiment, the ballast protection circuit 50 is operable to shut down the ballast 10 in response to sensed excessive heat. In other embodiments, however, the ballast 10 may simply be placed in a protected state so that it supplies very little power to the lamp load 70 in response to the sensed excessive heat. Once again, regardless of exactly how the ballast protection circuit 50 handles an overheating condition, the important point is that the ballast protection circuit 50 should place the ballast 10 in a protected state so that the ballast 10 will not be damaged by excessive heat.

The ballast protection circuit 50 is operable to control the ballast 10 so that it provides shut-down protection, reignition, and multiple lamp striking capabilities. It is very desirable to customers for a ballast to automatically shut down, or to be placed in some other type of protected state, i.e., a disconnected protected state, when a lamp is disconnected from the ballast to ensure that the high voltage present at the lamp connection terminals of the ballast output circuit does not pose any harm to customers. Customers also prefer ballasts that automatically reignite, i.e., ignite a gas discharge lamp, when a bad lamp is disconnected from and a new lamp is connected to a ballast while the input power remains on. The ballast protection circuit 50 is operable to provide these capabilities.

Customers further prefer lamp ballasts that provide a multiple striking capability for use in striking hard to ignite lamps. Cold, new, and old lamps can be difficult to ignite using only a single striking attempt. The ballast protection circuit 50 of the present invention commands the ballast 10 to generate multiple striking attempts in order to ignite these types of lamps. The ballast protection circuit 50 of the present invention, however, will not provide an indefinite number of strikes. As is known in the art, circuits that provide an indefinite number of striking attempts can cause the lamp to repeatedly flash off and on. Not surprisingly, many customers find the flashing to be annoying. Accordingly, the ballast protection circuit 50 provides an adjustable, limited number of striking attempts to prevent this type of situation from occurring.

Figure 3:
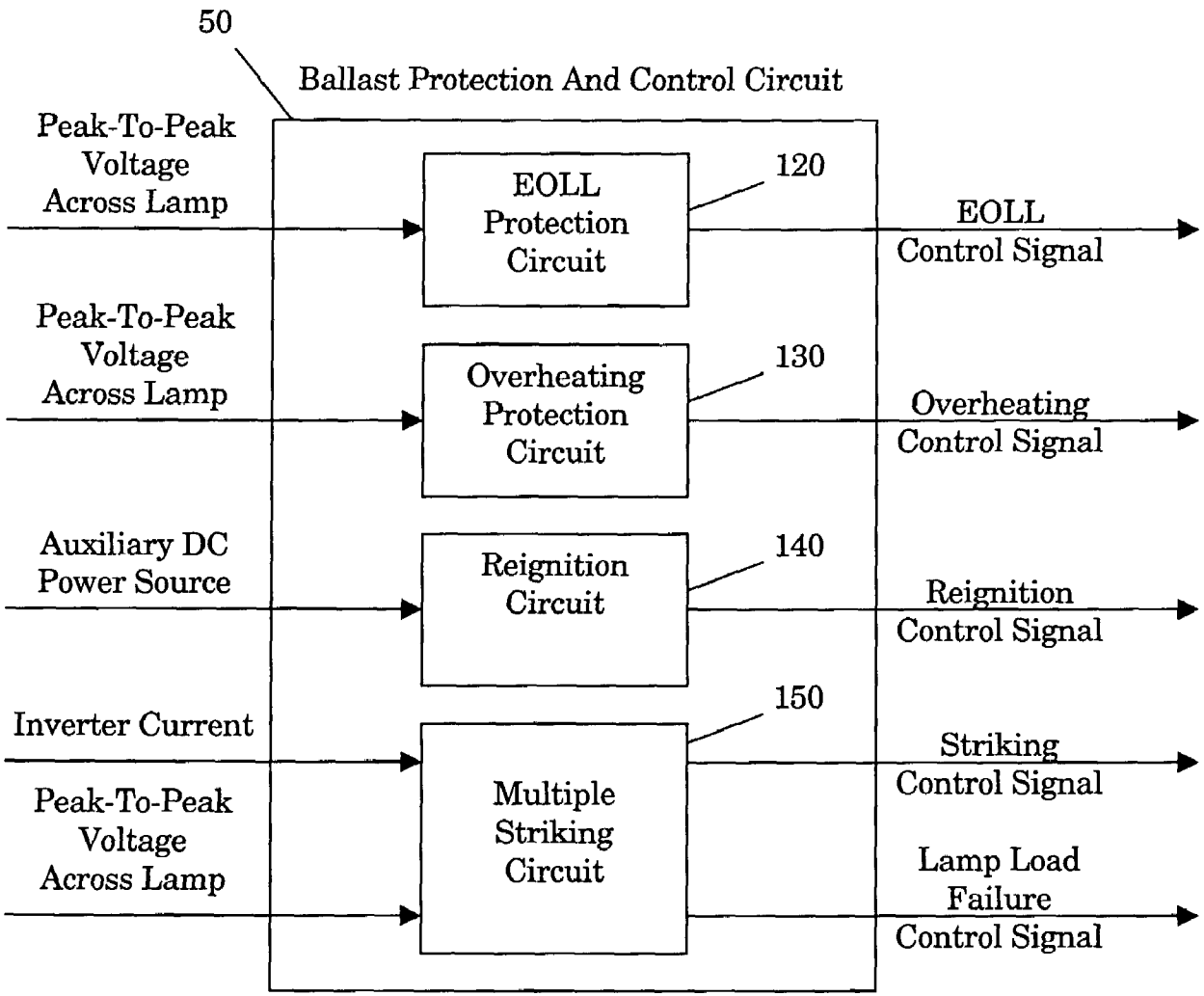
FIG. 3 is a block diagram showing a preferred embodiment of the ballast protection and control circuit of the present invention.
Figure 4:
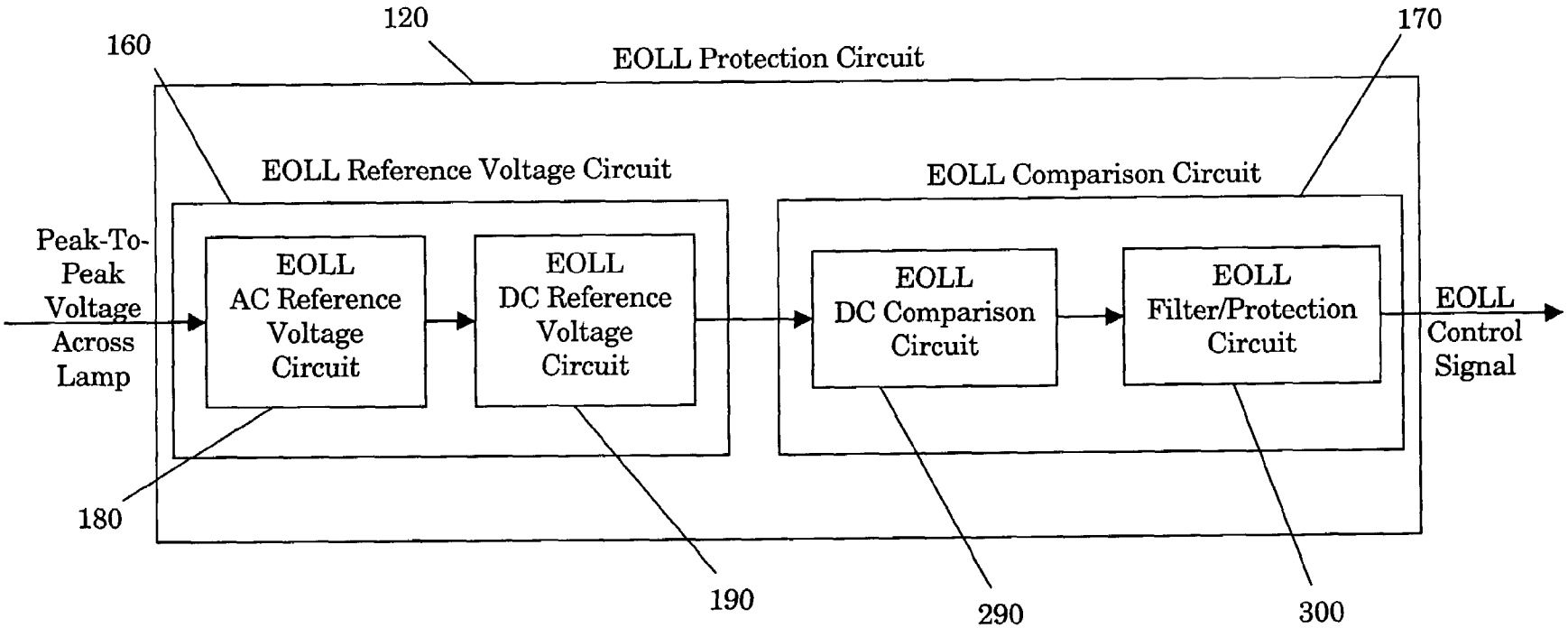
FIG. 4 is a block diagram showing a preferred embodiment of the end of lamp life protection circuit of the present invention.

Referring now to FIGS. 3–4, one embodiment of the ballast protection and control circuit 50 of the present invention includes an end of lamp life protection circuit 120 (EOLL protection circuit 120 or EOLL sensing and control circuit 120), an overheating protection circuit 130 (or overheating sensing and control circuit 130), a reignition circuit 140 (also referred to as a reignition sensing and control circuit 140), and a multiple striking circuit 150 (also referred to as a multiple striking sensing and control circuit 150). The EOLL protection circuit 120 is operable to sense the voltage applied by the ballast 10 across the lamp load 70 and to generate an end of lamp life control signal (EOLL control signal) when the sensed voltage exceeds a predetermined level for a predetermined time period. The EOLL control signal can be used to cause the ballast 10 to enter an end of lamp life protected state so that the ballast 10 and the lamp load 70 cannot be damaged by an end of lamp life condition.

As is well known in the art, gas discharge lamps included in the lamp load 70 of the present invention rectify AC current, i.e., generate a DC current, as they approach the end of their effective operating lifetime. The rectification may generate a positive DC voltage, referred to as positive rectification, or may generate a negative DC voltage, referred to as negative rectification. In addition, in some cases the failure of these lamps causes a symmetric excessively high voltage to appear across the lamps. The EOLL protection circuit 120 of the present invention senses and generates an end of lamp life control signal in response to all three of these types of conditions.

Figure 8:
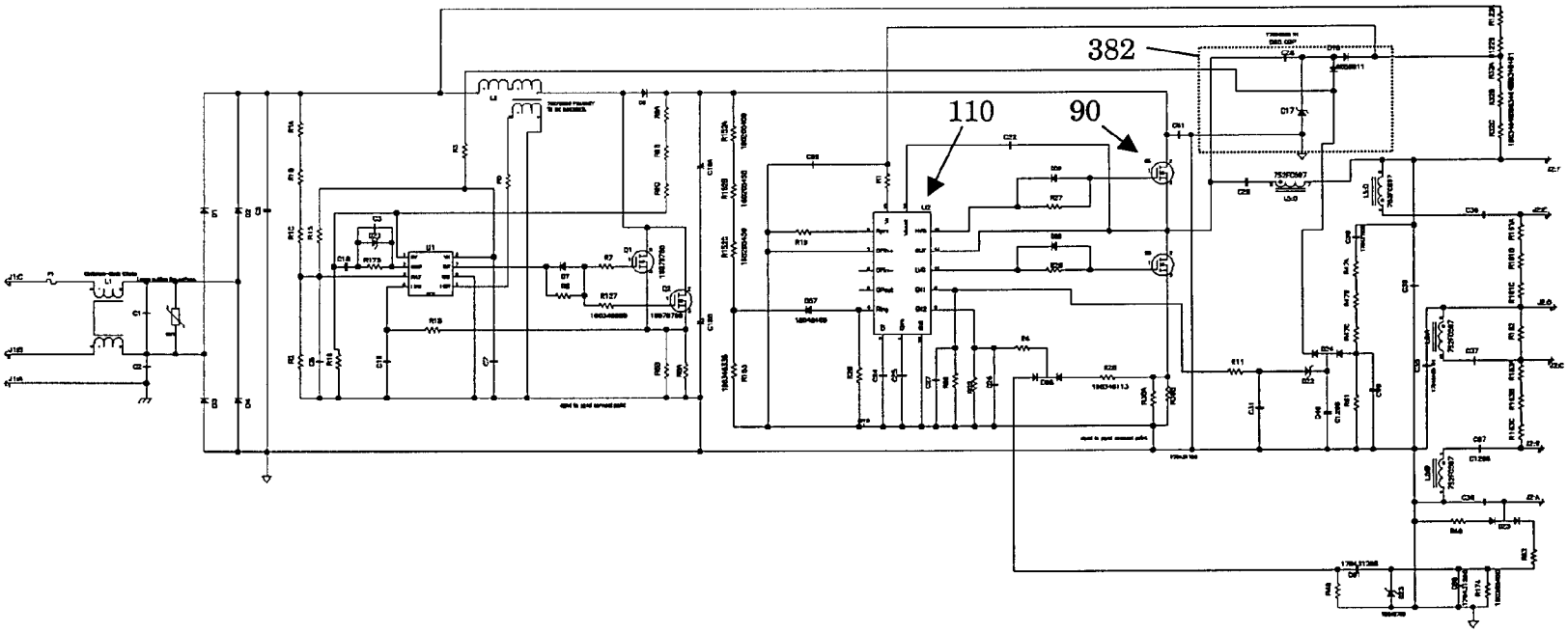
FIG. 8 is a schematic drawing of the preferred embodiment of the present invention shown in FIG. 1.
Figure 8A:
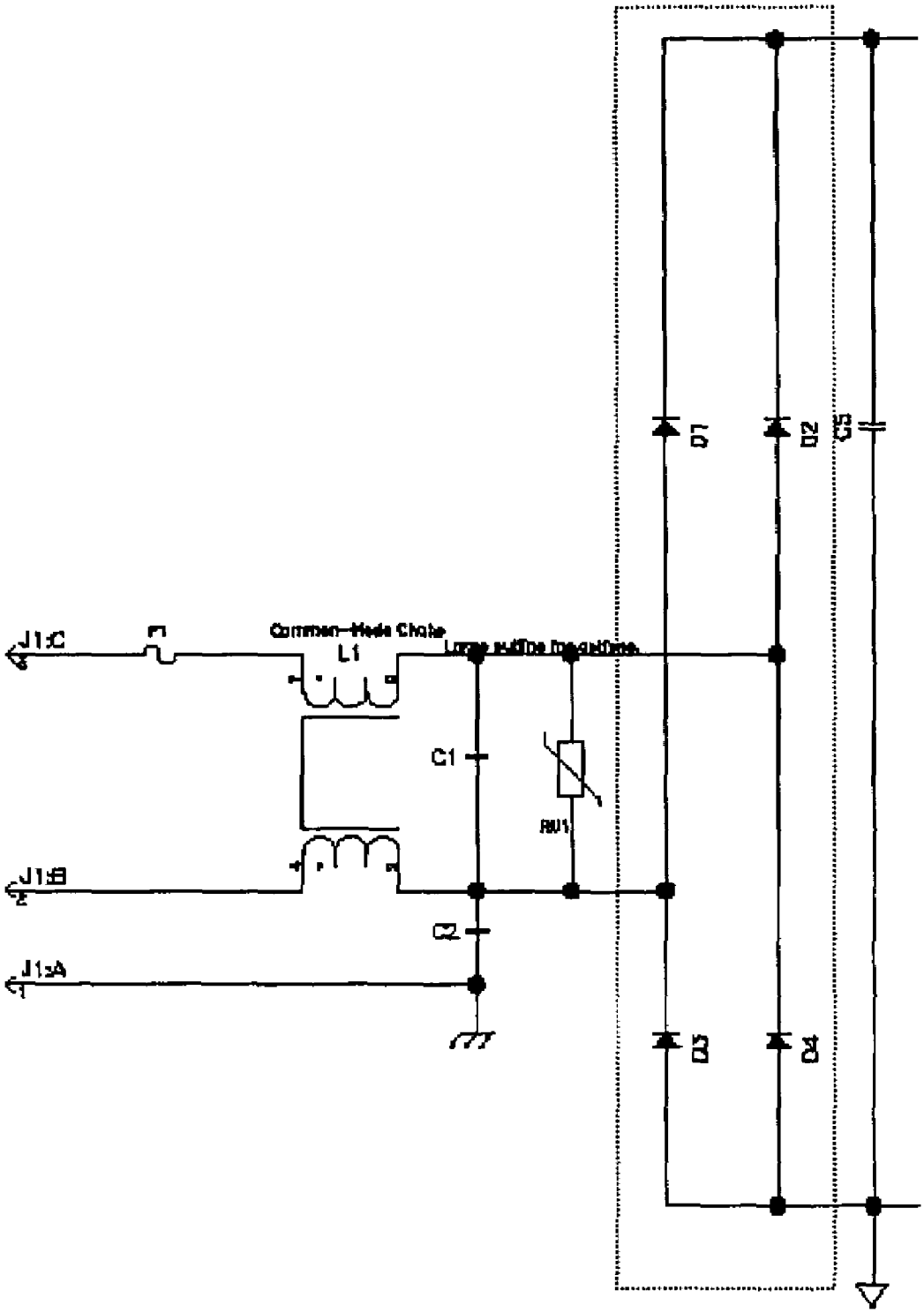
FIGS. 8*a*–8*i* are schematic drawings including dashed lines showing enlarged views of the various circuits shown in FIG. 8.
Figure 8B:
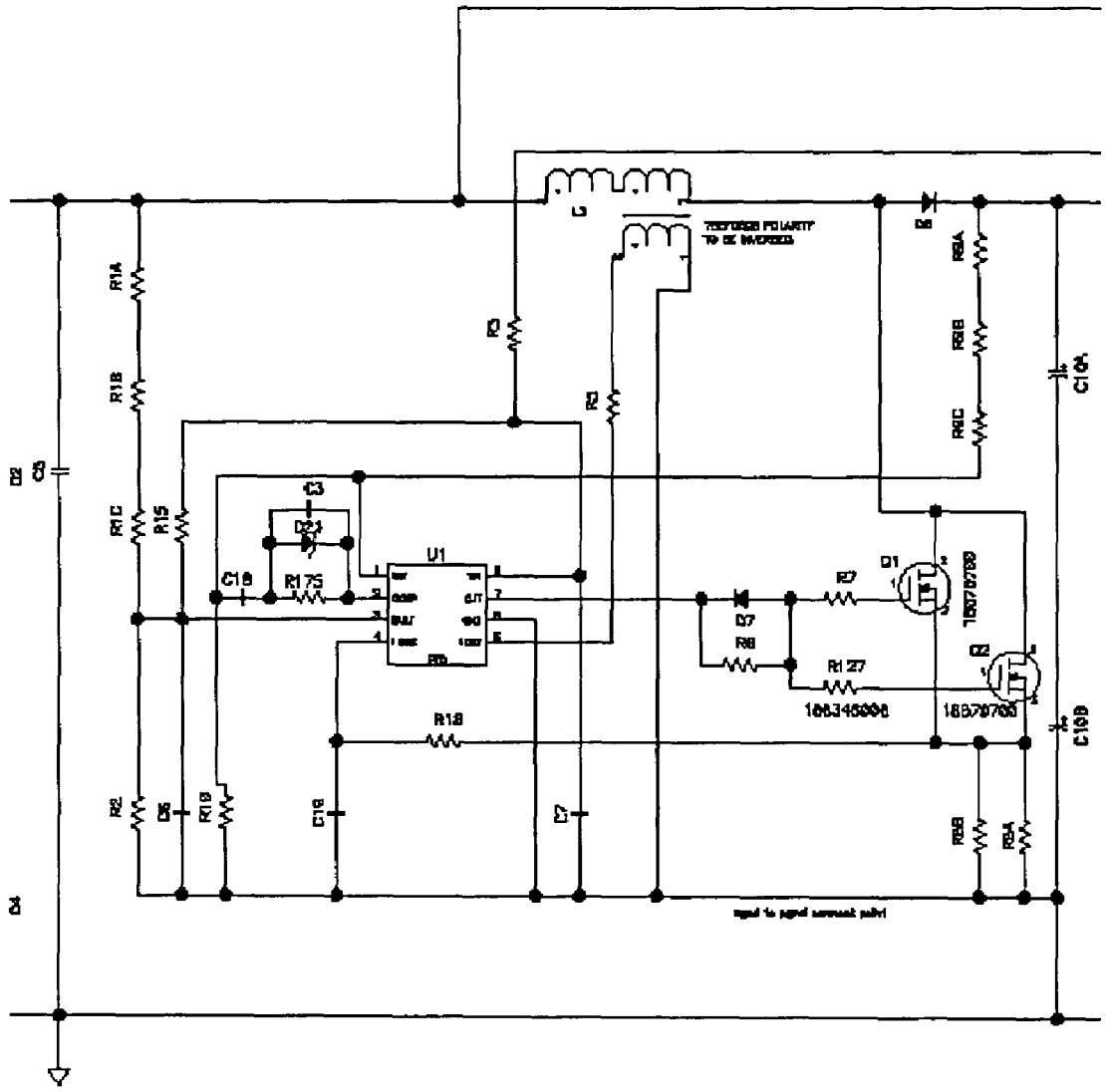
Figure 8C:
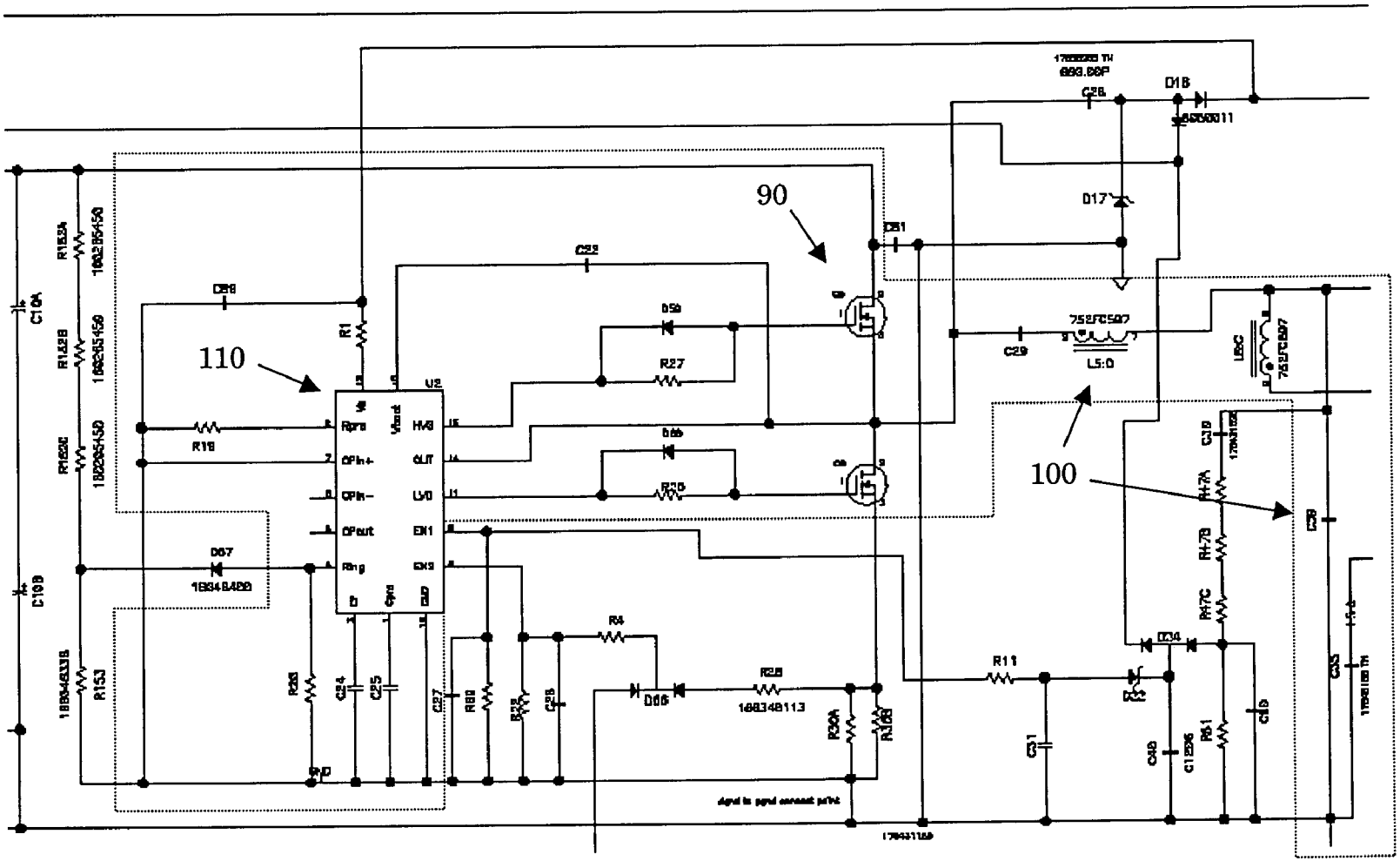
Figure 8D:
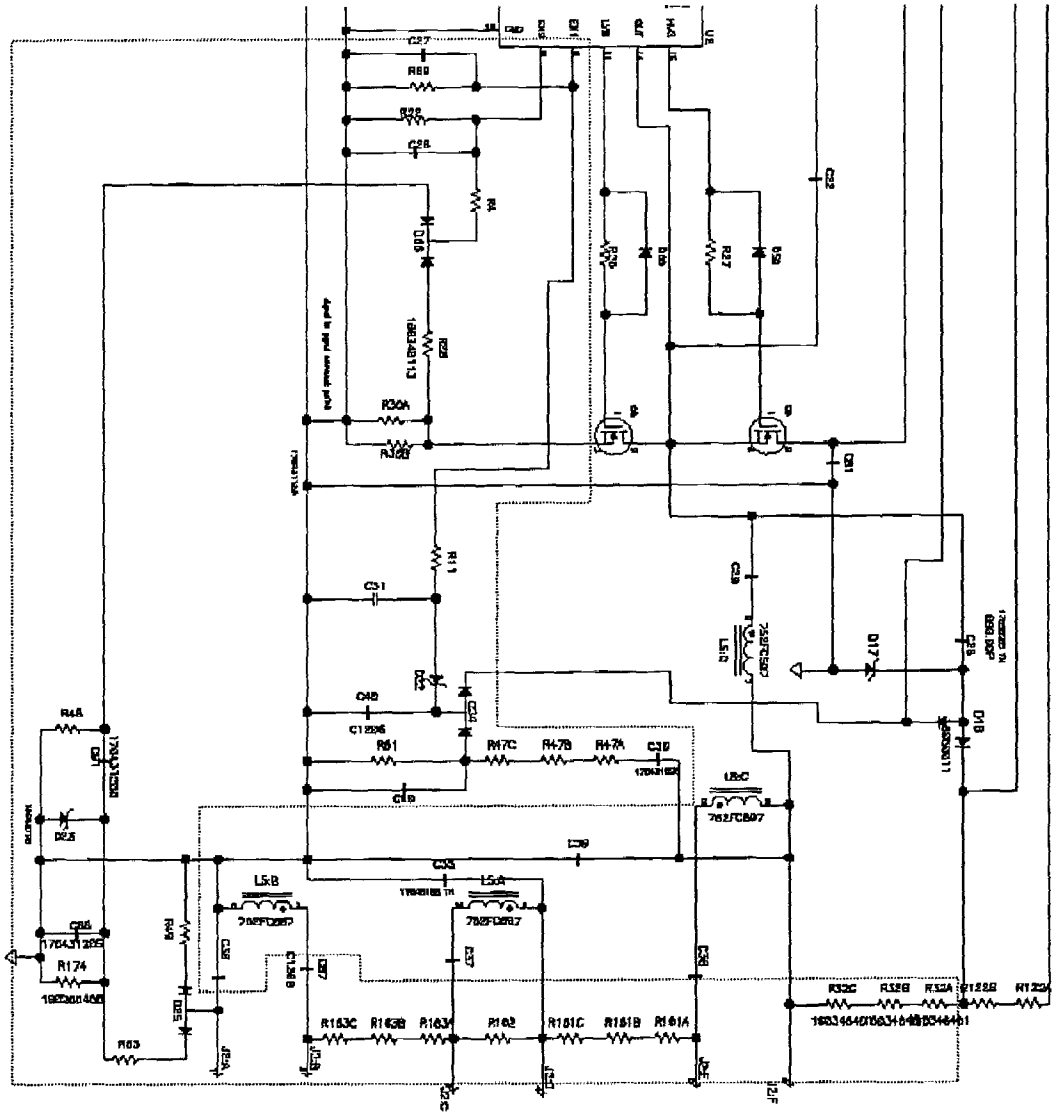
Figure 8E:
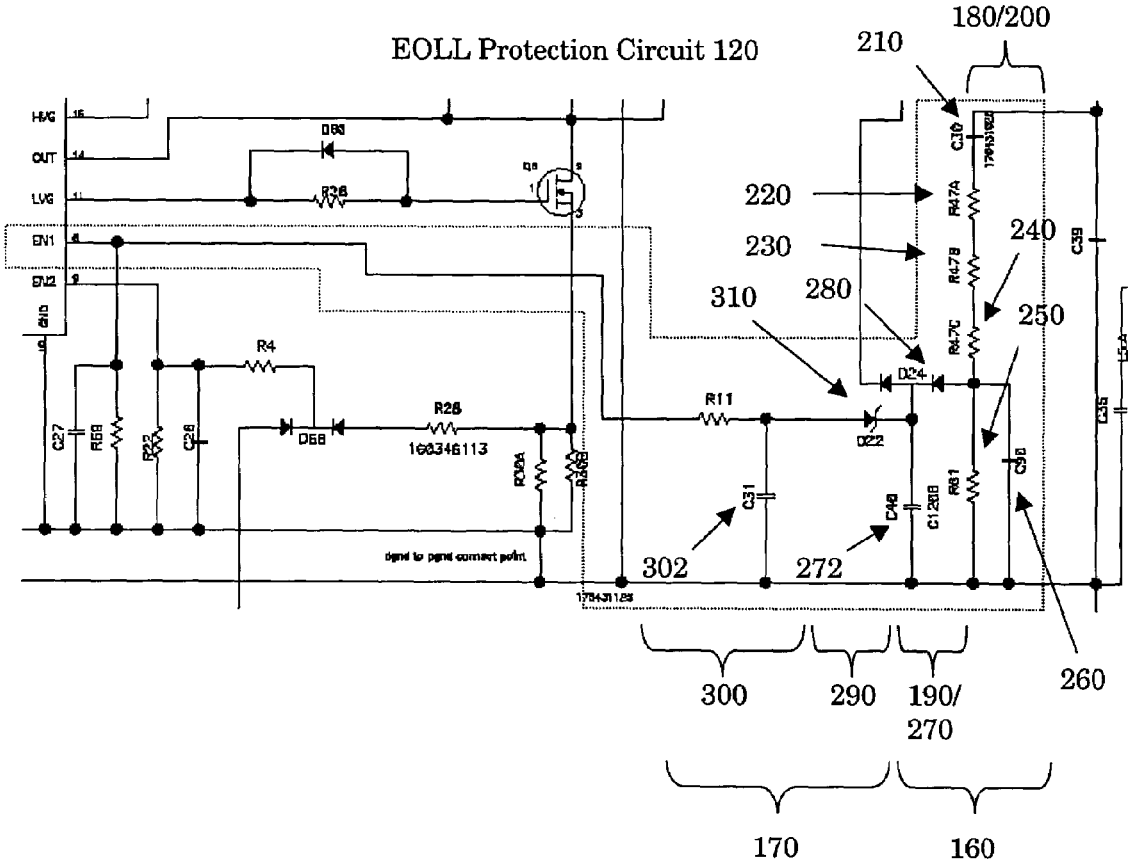

Referring specifically to FIGS. 4 and 8*e*, in a preferred embodiment, the EOLL protection circuit 120 includes an end of lamp life reference voltage circuit 160 (EOLL reference voltage circuit 160) and an EOLL comparison circuit 170. The EOLL reference voltage circuit 160, which is connected in parallel with the lamp load 70 (see FIGS. 8 and 8*e*), senses the peak-to-peak voltage across the lamp load 70, which is the voltage output across the tank capacitor in the inverter series resonant LC output circuit 100 (see FIG. 8*c*), and generates an EOLL DC voltage signal representative of that voltage signal. The EOLL comparison circuit 170 compares that DC voltage signal to a predetermined EOLL DC reference voltage (or simply a predetermined EOLL reference voltage) and generates the EOLL control signal if the EOLL DC voltage signal exceeds the predetermined EOLL DC reference voltage.

It is important to note that by connecting the EOLL protection circuit 120 in parallel with the lamp load 70, the current flowing through the EOLL protection circuit 120 may be reduced to a level that is significantly lower than the current if sensed through the lamp load 70 or the tank capacitor in the inverter series resonant LC output circuit 100. This reduces the amount of power consumed by the EOLL protection circuit 120 and makes it more efficient than prior art circuits that use higher currents.

To generate the DC voltage signal representative of the peak-to-peak voltage signal across the lamp load 70, the EOLL reference voltage circuit 160 includes an end of lamp life AC reference voltage circuit 180 (EOLL AC reference voltage circuit 180) and an end of lamp life DC reference voltage circuit 190 (EOLL DC reference voltage circuit 190). The EOLL AC reference voltage circuit 180 is operable to generate an EOLL AC voltage signal representative of the peak-to-peak voltage across the lamp load 70 and the EOLL DC reference voltage circuit 190 is operable to convert that AC voltage signal into the required EOLL DC voltage signal.

In a preferred embodiment, the EOLL AC reference voltage circuit 180 includes an EOLL resistor/capacitor voltage divider network 200 (see FIG. 8*e*) having an EOLL sensing capacitor 210 connected in series with four EOLL resistors 220, 230, 240, and 250 to tolerate the high voltage. The EOLL AC reference voltage circuit 180 also includes an optional high frequency capacitor 260 (to accommodate frequency shifting effects when the boost is out of regulation due to low input line voltages) connected in parallel with EOLL resistor 250. This high frequency capacitor 260 is included to prevent high lamp peak voltage caused by low AC power line input voltages from inadvertently triggering a false EOLL control signal but would not be required in applications where this did not occur. The resulting combination of resistors and capacitors generates an AC voltage signal across EOLL resistor 250 that is representative of the peak-to-peak AC voltage across the lamp load 70.

EOLL DC reference voltage circuit 190 includes an EOLL rectifier circuit 270 (see FIG. 8*e*), which, in a preferred embodiment simply includes an EOLL diode 280 (or one diode from a two-diode package) and an EOLL rectifier circuit charging capacitor (or EOLL time delay circuit) 272. The EOLL diode 280 rectifies the AC voltage signal applied to the EOLL diode 280 and generates a DC charging current signal that charges EOLL rectifier circuit charging capacitor 272. The resulting DC voltage signal across EOLL rectifier circuit charging capacitor 272, after it has been charged to a predetermined DC voltage level, is the EOLL DC voltage signal representative of the peak-to-peak voltage across the lamp load 70.

The time required to charge the EOLL rectifier circuit charging capacitor 272 generates a time delay between the time that the AC voltage signal across EOLL resistor 250, which is representative of the peak-to-peak AC voltage across the lamp load 70, exceeds a predetermined reference output voltage level and the time that the EOLL DC voltage signal is generated. Or, in other words, the EOLL rectifier circuit charging capacitor 272 causes the EOLL DC voltage signal to be generated only after the AC voltage across the lamp 70 has exceeded the predetermined reference voltage level for a predetermined time period. This delay is necessary in order to prevent transient high voltage conditions across the lamp load 70, which are not caused by an end of lamp life condition in the lamp load 70, from falsely triggering the EOLL control signal.

The EOLL comparison circuit 170 includes an EOLL DC comparison circuit 290 and an optional EOLL filter/protection circuit 300. The EOLL DC comparison circuit 290 is operable to compare the EOLL DC voltage signal representative of the peak-to-peak voltage across the lamp load 70 to a predetermined EOLL DC reference voltage level and to generate the EOLL control signal when the DC voltage signal exceeds the predetermined DC reference voltage level. The EOLL filter/protection circuit 300 is operable to filter the EOLL control signal so that it does not include noise and to prevent excessive current from flowing to the inverter driver integrated chip 110.

In a preferred embodiment, the EOLL DC comparison circuit 290 includes an EOLL Zener diode 310 (or EOLL reference component 310) that is connected to the EOLL diode 280 and the EOLL rectifier circuit charging capacitor 272. As is well known in the prior art, a Zener diode is designed to prevent current from passing through the diode unless the breakdown voltage of the diode has been exceeded. In this case, the breakdown voltage of EOLL Zener diode 310 (also referred to as the EOLL reference component 310) is chosen to be higher than the voltage across the EOLL rectifier circuit charging capacitor 272 during normal operation. Thus, when the EOLL DC voltage signal on the EOLL rectifier circuit charging capacitor 272 exceeds the breakdown voltage of EOLL Zener diode 310 plus the reference voltage on shut-down pin (pin 8 EN1) on inverter driver integrated chip 110, the system 10 interprets this condition as an indication that the peak-to-peak voltage across the lamp load 70 has exceeded the predetermined EOLL DC voltage level. In other words, the EOLL Zener diode 310 is used to set the predetermined EOLL reference voltage by using its breakdown voltage.

One skilled in the art will recognize that the EOLL Zener diode 310 is acting like a voltage controlled switch in the EOLL DC comparison circuit 290 and that other types of voltage controlled switches, such as diacs or transistors, may be used as well. As a result, the EOLL Zener diode 310 may be more generally referred to as EOLL voltage controlled switch 310 and the breakdown voltage may be referred to as the EOLL switching voltage.

To filter the EOLL control signal and to prevent excessive current from flowing to the inverter driver integrated chip 110, the EOLL filter/protection circuit 300 includes an EOLL filter capacitor 302 connected to the EOLL Zener diode 310. When the breakdown voltage of EOLL Zener diode 310 is exceeded, a DC current flows through the EOLL Zener diode 310 and charges EOLL filter capacitor 302. This capacitor cannot be charged instantaneously and the time required to charge the capacitor prevents, or filters out, noise that may be included with the EOLL control signal.

Once the EOLL control signal is generated, it is supplied to and used by the inverter driver integrated chip 110 (see FIG. 8*c*) to control the output of the inverter circuit 40. In a preferred embodiment, the inverter driver integrated chip 110 is operable to shut down the inverter circuit 40 in response to the EOLL control signal. In other embodiments, the inverter driver chip 110 may be operable to simply reduce the amount of power that is output by the inverter circuit 40. This is typically done by increasing the oscillating frequency of the inverter circuit 40 to reduce the output lamp current and lamp power.

Figure 5:
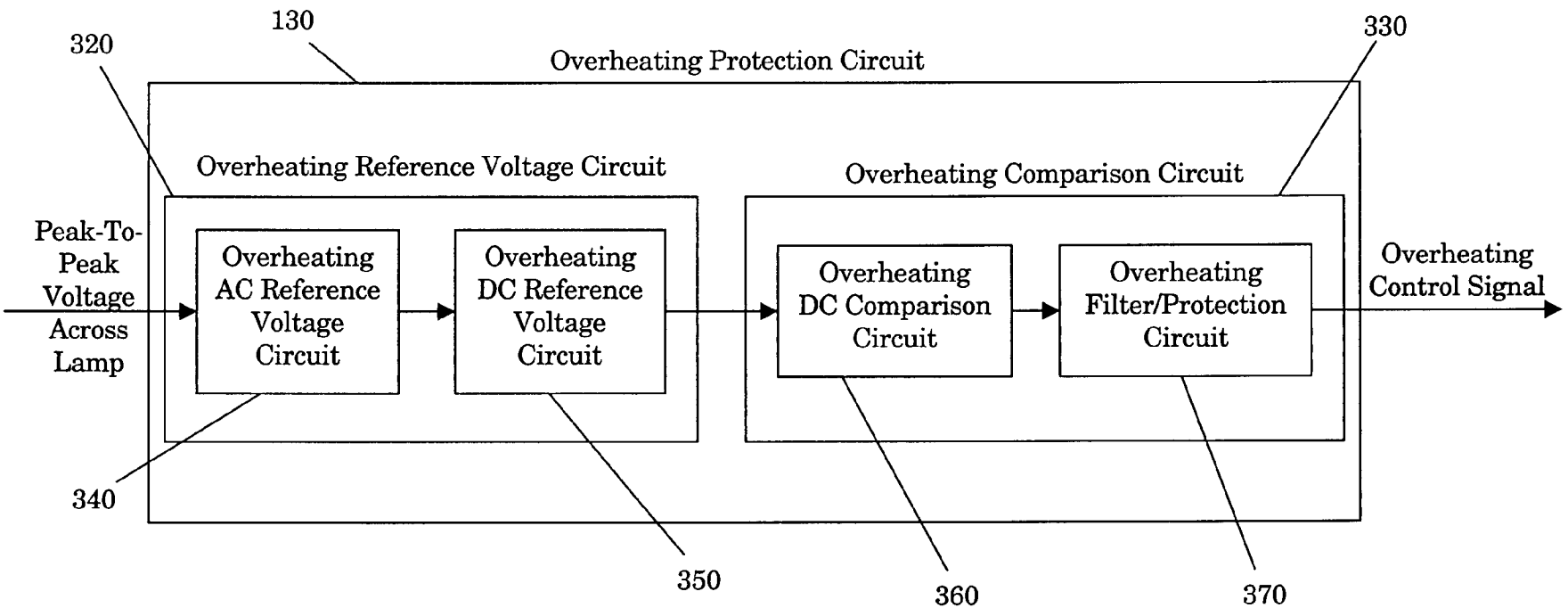
FIG. 5 is a block diagram showing a preferred embodiment of the overheating protection circuit of the present invention.
Figure 8F:
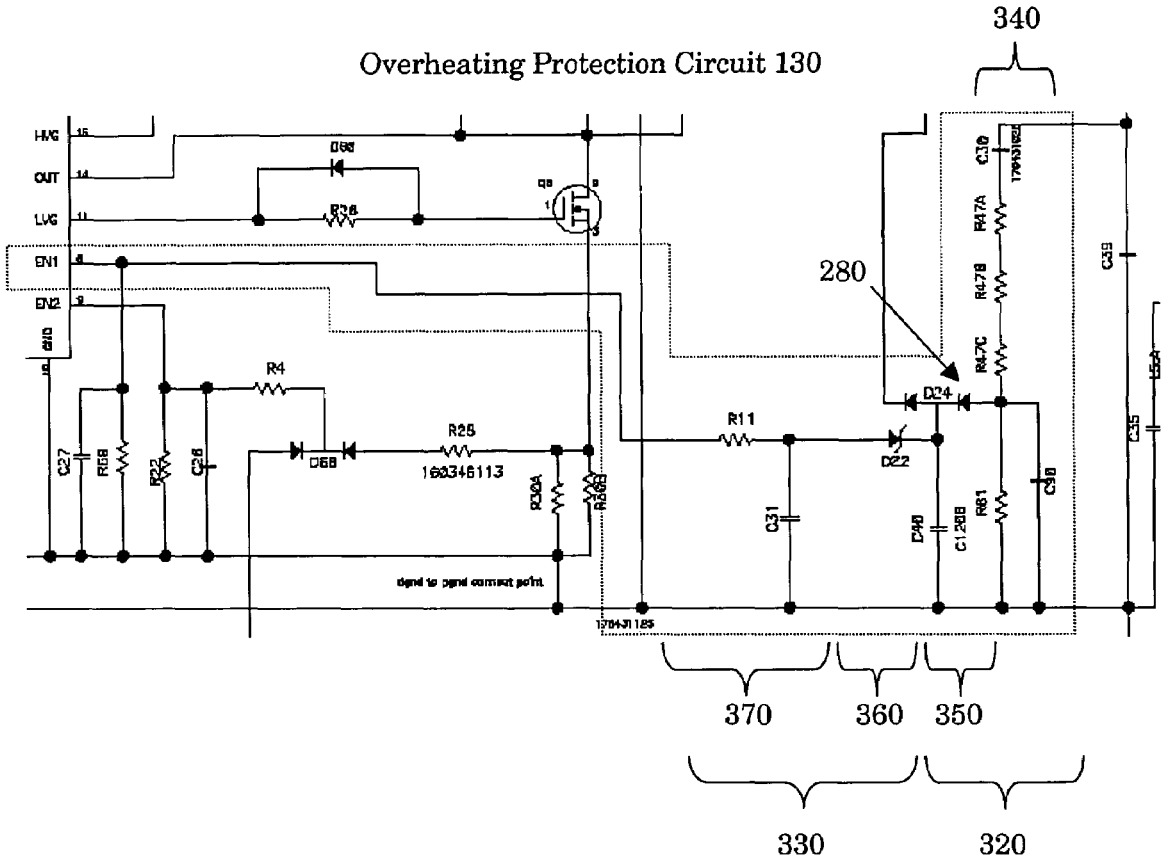

Turning now to FIGS. 5 and 8*f*, the overheating protection circuit 130 is operable to sense the operating temperature of the ballast 10 and to generate an overheating control signal when the sensed temperature exceeds a predetermined temperature level for a predetermined time period. As was the case with the EOLL control signal, the overheating control signal can be used to cause the ballast 10 to enter a protected state, i.e., an overheating protected state, so that the ballast 10 and the lamp load 70 cannot be damaged by the undesired overheat.

To accomplish this function, the overheating protection circuit 130 is operable to generate an overheating reference voltage signal that is representative of a normal operating temperature of the ballast 10 and to compare that reference voltage to a predetermined overheating reference voltage. When the overheating reference voltage generated by the overheating protection circuit 130 exceeds the overheating reference voltage plus the reference voltage on shut-down pin (pin 8 EN1) on inverter driver integrated chip 110, the overheating protection circuit 130 generates an overheating control signal. The overheating control signal is then supplied to the inverter microcontroller 110, which uses it to either shut down the inverter circuit 40 or reduce the amount of power being delivered to the lamp load 70 as discussed above with regard to the EOLL protection circuit 120.

Unlike prior art overheating protection circuits, the overheating protection circuit 130 of the present invention is adapted to generate an overheating control signal only after an overheating condition occurs and using an overheating reference component. At normal ballast operation temperature, the overheating control signal is essentially nothing and, when an overheating condition occurs, the overheating control signal increases after the breakdown voltage of Zener is reached up to a predetermined overheating reference voltage. This allows the overheating protection circuit of the present invention to more accurately sense overheating conditions when compared to prior art overheating protection circuits. This is true because prior art overheating protection circuits always generate some significant overheating control signal (for instance, at least 50% of the trig level) even when the ballast temperature is normal and the difference can not clearly determined between high shutdown temperature and normal operating temperature.

To implement the overheating protection feature, the overheating protection circuit 130 is operable to generate an overheating reference voltage signal that is dependent upon the operating temperature of the ballast 10. At nominal operating temperatures, the overheating protection circuit 130 generates a nominal overheating reference voltage. When the operating temperature of the ballast 10 increases, the overheating reference voltage generated by the overheating protection circuit increases as well. This increase, in turn, causes the overheating protection circuit 130 to generate the overheating control signal.

In a preferred embodiment, the overheating protection function is implemented using a temperature sensitive electronic component that is included with the overheating protection circuit 130 and that changes its operating characteristics in response to its temperature changes. It is important to note that, although its temperature is different from the ballast temperature, their changes are usually identical. More specifically, the preferred embodiment includes a temperature sensitive diode that has a forward voltage drop that decreases as the operating temperature of the diode increases. This component is discussed in more detail below.

In the preferred embodiment, the overheating protection circuit 130 is implemented using the circuit components used with the EOLL protection circuit 120 discussed above. As a result, the overheating protection circuit 130 includes an overheating reference voltage circuit 320 and an overheating comparison circuit 330, both of which are identical to and operate in a manner that is identical to the operation of these components in the EOLL protection circuit 120, i.e., the EOLL reference voltage circuit 160 and the EOLL comparison circuit 170, respectively. In other words, the overheating reference voltage circuit 320 is operable to generate a DC reference voltage representative of the peak-to-peak voltage across the lamp load 70 and the overheating comparison circuit 330 is operable to compare that DC reference voltage to a predetermined overheating DC reference voltage level. When the overheating DC reference voltage exceeds the predetermined overheating DC reference voltage level, the overheating protection circuit 130 generates the overheating control signal.

As shown in FIGS. 5 and 8*f*, the overheating reference voltage circuit 320 includes an overheating AC reference voltage circuit 340 and an overheating DC reference voltage circuit 350. In a similar manner, the overheating comparison circuit 330 includes an overheating DC comparison circuit 360 (which includes overheating Zener diode 310 or overheating reference component 310) and an overheating filter/protection circuit 370. The overheating AC reference voltage circuit 340, overheating DC reference voltage circuit 350, overheating DC comparison circuit 360, and overheating filter/protection circuit 370 are identical to the EOLL AC reference voltage circuit 180, EOLL DC reference voltage circuit 190, EOLL DC comparison circuit 290, and EOLL filter/protection circuit 300, respectively.

It is important to note that the dual use of the EOLL protection circuits for both EOLL protection and overheating protection reduces the number of components required by the ballast 10 of the present invention to implement both of these protection features and, consequently, reduces the cost of this ballast. In addition, it is also important to note that the integration of these two circuits allows the EOLL protection circuit to be implemented with EOLL and overheating protection features and the overheating protection circuit to be implemented with overheating protection and EOLL features. These are additional benefits of the present invention. In alternative embodiments, these protection circuits may be implemented separately as well.

The operation of the overheating protection circuit 130 will now be discussed in detail with reference to the EOLL protection circuit 120 discussed above because these two circuits, and the control signals that they generate, the EOLL control signal, and the overheating control signal, are identical in the preferred embodiment of the present invention. It is important to note that these circuits can be implemented separately and the EOLL protection circuit 120 may operate at a point out of the range of the change of the temperature sensitive diode or include a low temperature characteristic diode. In a similar manner, the overheating protection circuit 130 may not be implemented using the same AC and DC reference voltages used in the EOLL protection circuit 120. The overheating protection circuit 130 may be implemented with a variety of different AC and DC reference circuits and voltages as long as those circuits include temperature sensitive electrical components that change their operating characteristics in response to temperature changes and generate voltages that are dependent on these changes.

As discussed above in connection with the EOLL protection circuit 120, the EOLL DC reference voltage circuit 190 includes an EOLL diode 280 (see FIG. 8) that is used to generate the EOLL DC reference voltage by rectifying the EOLL AC reference voltage signal generated by the EOLL AC reference voltage circuit 180. The applicant of the present invention has recognized that the operating characteristics of the EOLL diode 280 vary in response to changes in its temperature. More specifically, the applicant has recognized that the forward voltage drop across this chosen diode could reduce from approximately 0.7 volts, for instance, at a nominal ballast operating temperature to approximately as low as 0.5 volts or so at very high ballast temperatures.

The applicant has further recognized that this change in operating characteristics can be used to measure the operating temperature of the ballast 10 and to generate an overheating control signal if that temperature gets too high. To implement this feature of the invention, the EOLL DC reference voltage circuit 190 has been designed so that the EOLL DC reference voltage generated by that circuit is dependent on the voltage drop across the EOLL diode 280. At normal operating temperatures, the EOLL DC reference voltage circuit 190 generates a nominal EOLL DC reference voltage that will not result in the generation of the overheating control signal. When the operating temperature of the ballast 10 increases, causing a similar temperature increase on the EOLL diode 280, the voltage drop across the EOLL diode 280 decreases causing an increase in the voltage drop across the EOLL rectifier circuit charging capacitor 272. As indicated above, the voltage across the EOLL rectifier circuit charging capacitor 272 is the EOLL DC reference voltage. Thus, an increase in the operating temperature of the ballast 10 causes an increase in the EOLL DC reference voltage generated by the EOLL DC reference voltage circuit and this causes the generation of the EOLL control signal. Note that this increase occurs even though the other operating characteristics of the ballast 10, such as power output to the lamp load 70, remain the same. In one embodiment, the EOLL diode 280 is designed and chosen so that the forward voltage drop is approximately 0.7 volts at 75 degrees Celsius ballast temperature and drops to approximately 0.5 volts when the ballast temperature exceeds 130 degrees Celsius. Consequently, in this embodiment, the overheating protection circuit 130 protects the ballast 10 if the temperature exceeds 130 degrees Celsius.

Figure 6:
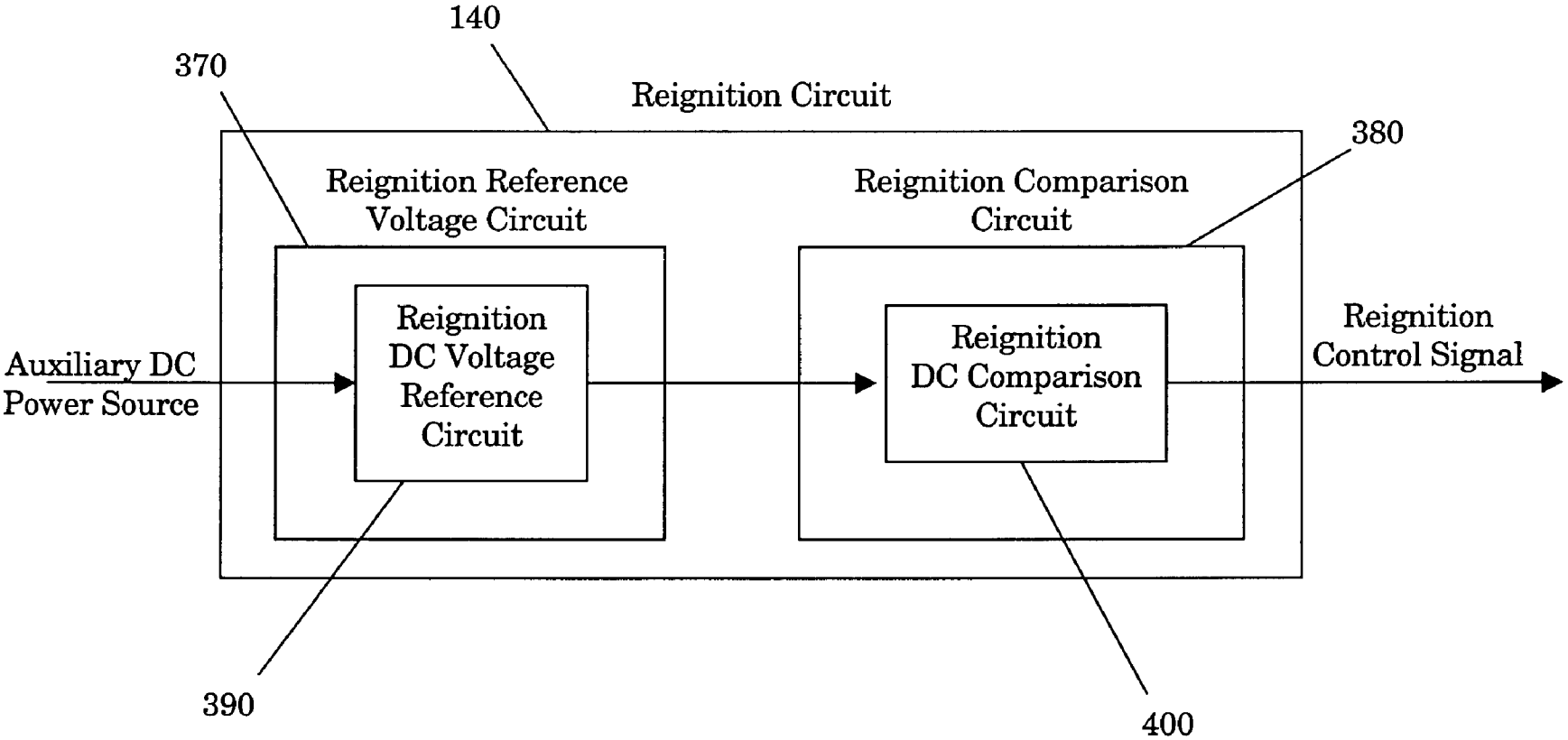
FIG. 6 is a block diagram of the automatic reignition circuit of the present invention.
Figure 8G:
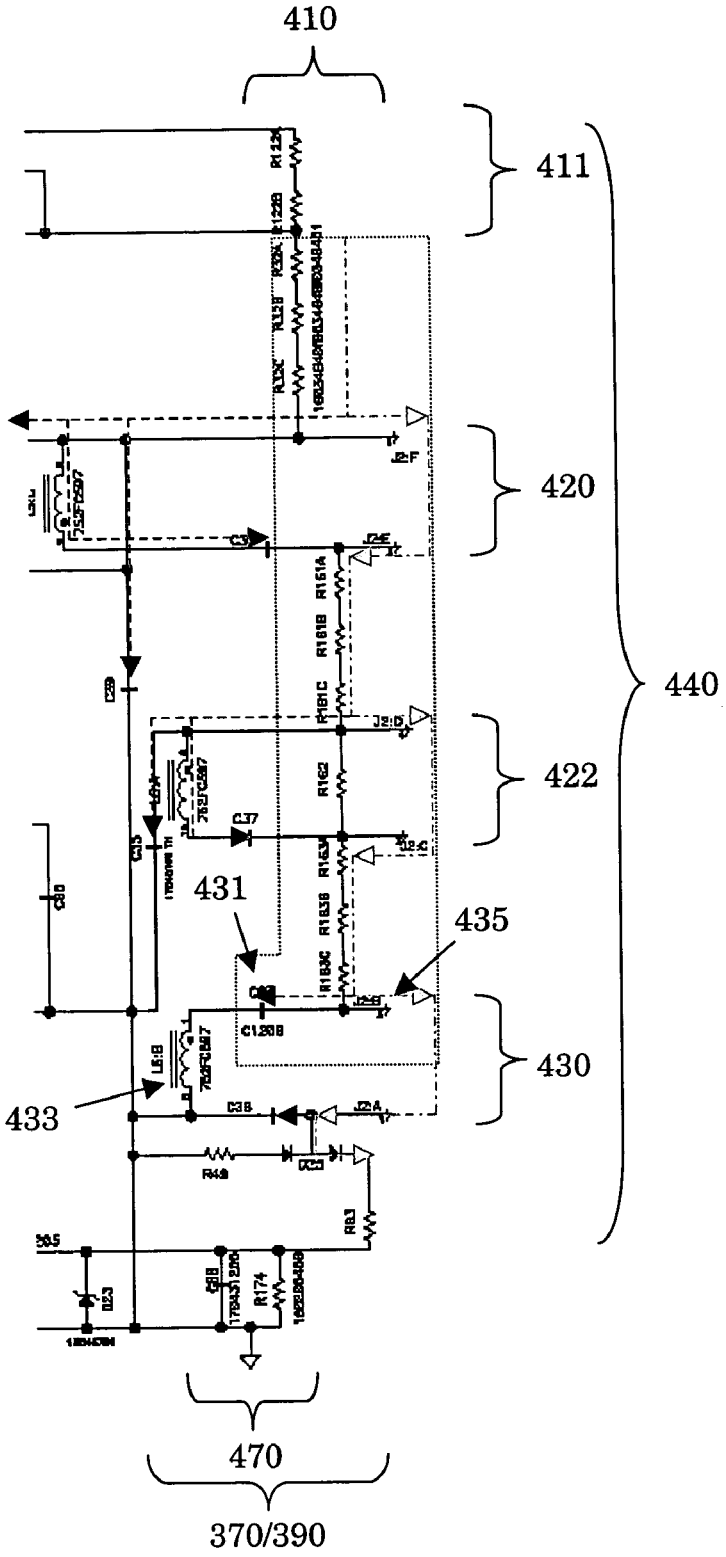

Referring to FIGS. 6, 8*g* (upper portion of reignition circuit), and 8*h* (lower portion of reignition circuit), the reignition circuit 140 is operable to sense the filament continuity when the lamp load 70 is reconnected to the ballast 10 after previously being removed and to generate an ignition control signal that can be used to cause the inverter circuit 40 to attempt to ignite the lamp load 70. It should be noted that the power applied to the ballast 10 remains on during the disconnection and reconnection process. In addition, as explained in more detail below, the reignition control signal is only generated after the lamp load 70 has been disconnected for a predetermined amount of time.

To accomplish this function, the reignition circuit 140 includes a reignition reference voltage circuit 370 and a reignition comparison circuit 380. Although both of these components include names that are similar to the names used with circuits in the EOLL protection circuit 120 and the overheating protection circuit 130, and perform similar functions, the reignition circuits are different from those components. Note also that resistors 411 shown in FIG. 8*g* are not part of the reignition circuit 140. These resistors are used to start up the inverter driver chip 110 using power supply by the AC/DC rectifier circuit 20 in a manner known in the prior art.

The reignition circuit 140 also includes a DC power source 382, for example, the auxiliary power supply for the inverter integrated chip (see FIG. 8) that is used to supply power to the reignition reference voltage circuit 360 and comparison circuit 380 as explained in more detail below.

The reignition reference voltage circuit 360 is operable to generate a reignition reference voltage that provides an indication that the lamp load 70 has been reconnected to the ballast 10. The reignition comparison circuit 380 compares the reignition reference voltage to a predetermined reignition reference voltage and, when the reignition reference voltage exceeds the predetermined voltage, generates the reignition control signal. The reignition control signal is then sent to the inverter microcontroller 110, which attempts to ignite the lamp load 70 in response to this control signal.

In a preferred embodiment, the reignition reference voltage circuit 370 simply includes a reignition DC reference voltage circuit 390 and the reignition comparison circuit 380 simply includes a reignition DC comparison voltage circuit 400. The reignition DC reference voltage circuit 380 is operable to generate a reignition DC reference voltage after the lamp load 70 has been connected to the ballast 10 for a predetermined amount of time and the reignition comparison circuit 380 is operable to compare that reference voltage to a predetermined reignition DC reference voltage. When the reignition DC reference voltage exceeds the predetermined reignition DC reference voltage, the reignition DC comparison circuit generates the reignition control signal.

As shown in FIGS. 8 and 8*g*, one embodiment of the reignition DC reference voltage circuit 390 includes a series resistor network 410 that is connected to the DC voltage output by the auxiliary DC power source 382 and includes multiple resistors connected in series with one another to generate a DC resistor path across all the lamp filaments. The reignition DC reference voltage circuit 390 also includes three pairs of lamp filament terminals, 420, 422, and 430, which can be connected to the lamp load 70. When the lamp load 70 is connected to all three sets of terminals, 420, 422, and 430, the series resistor network 410 forms a reignition DC current generating circuit 440. The DC current generating circuit 440 generates a reignition DC current that flows from the auxiliary DC power source 382, through the series resistor network 410, and through the lamp filaments (not shown) connected to the terminals, 420, 422, and 430.

It should be noted that the reignition DC current flows as indicated above because other alternative paths are blocked by various capacitors, which are typically included in an electronic ballast for other purposes well known in the art (see FIG. 8*g*). An extra capacitor 431 is added and included as part of the reignition circuit 140 to block the path to ground through filament winding 433. The path shown with the lighter arrows is the DC current path used to check the filament continuity of the lamp load 70 and the path indicated with darker arrows shows the alternative paths that are blocked by the various capacitors.

An additional benefit of adding the capacitor 431 is that the ballast 10 is protected from being damaged if the upper terminal 435 of lamp terminal pair 430 is accidentally connected to ground. If upper terminal 435 is connected to ground by accident and the ballast 10 does not include capacitor 431, input AC line voltage will be applied directly to diode D4 (see FIG. 8*a*) in the AC/DC rectifier circuit 20 and cause it to fail. In other words, the input line voltage will be imposed on diode D4 while it is conducting and cause huge current flowing through and the diode will burn up. By introducing capacitor 431, which will have a large impedance at line frequency, the current flowing through diode D4 is dramatically limited and thus the diode is protected.

One skilled in the art will recognize that the reignition circuit 140 may receive the power necessary for generating the reignition DC current from any number of different types of DC power sources instead of the auxiliary DC power source 382. For example, a DC power source (not shown) that is not included in the reignition circuit 140 may be used to supply power to the reignition circuit 140.

It also should be noted that the number of pairs of lamp filament terminals may vary from one application to another. In the embodiment discussed above, the lamp load 70 includes two lamps and provides three pairs of lamp filament terminals (two of which are connected to each other either in parallel or in series). In other embodiments, however, the reignition circuit 140 might include two pairs or four pairs of lamp filament terminals depending on the number of lamps for a given application.

The reignition DC reference voltage circuit 390 also includes a reignition charging circuit 470 (see FIGS. 8*g* and 8*h*) that is charged by the reignition DC current and used to generate the required reignition DC reference voltage. In the embodiment shown in FIGS. 8*g* and 8*h*, the reignition charging circuit 470 includes a capacitor 472 and a voltage divider resistor 474 connected in parallel with one another. One skilled in the art will recognize that the capacitor 472 cannot be discharged instantaneously and will be discharged over a certain time period determined by the resistance of resistor 474 and the capacitance of capacitor 472. It is this discharging time period that would simulate the time between the moment that an old lamp is removed and the moment that a new lamp is replaced in practice. One skilled in the art will further recognize that this time delay may be varied by changing the resistance and capacitance of the resistor 474 and capacitor 472, respectively.

Another additional benefit obtained by the reignition circuit 140 of the present invention is regeneration of the reignition control signal. This is accomplished using diode pair 479 (see FIG. 8*h*), which is operable to rectify the AC filament voltage across winding 433 when the ballast 10 attempts to ignite the lamp load 70. This rectified signal is then supplied to the reignition charging circuit 470 and amplifies the resulting reignition control signal.

Figure 8H:
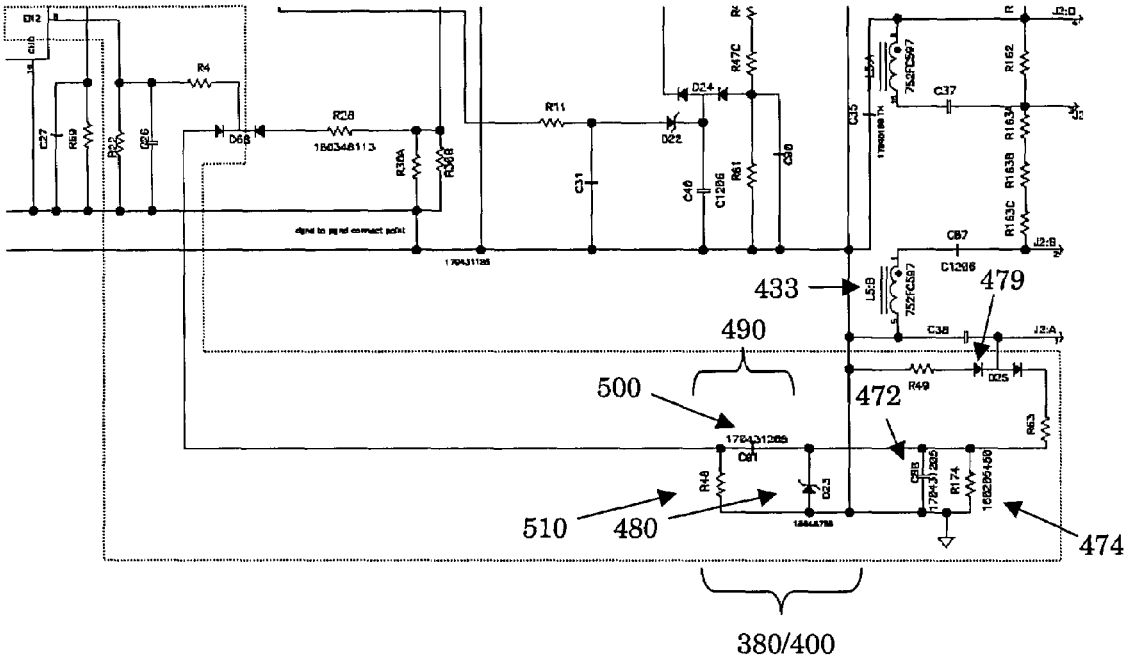

The reignition DC comparison circuit 400 is connected in parallel with the reignition DC reference voltage circuit 390 and includes a voltage clamping Zener diode 480 (also referred to as a reignition reference component or a reignition voltage clamping component) connected with a reignition differentiating circuit 490 (see FIG. 8*h*). The voltage clamping Zener diode 480 limits the negative voltage that can be developed across capacitor 472 in the presence of a negatively rectifying lamp and, as a result, prevents the reignition circuit 140 from inadvertently generating the reignition control signal after the ballast 10 has been placed in a protected state in response to a negative DC rectification end of lamp life condition.

The reignition differentiating circuit 490, in turn, includes a differentiating capacitor 500 and a differentiating resistor 510. The breakdown voltage of the voltage clamping Zener diode 480 is chosen to be high enough to generate the reignition control signal but not to generate a redundant ignition control signal after the first lamp is started.

One skilled in the art will also recognize that the voltage across the voltage clamping Zener diode 480 will remain approximately constant, or clamped, once the breakdown voltage of the Zener diode 480 is exceeded regardless of the current flowing through the Zener diode 480. The voltage across reignition capacitor 472 will also be clamped to the breakdown voltage of the Zener diode 480 because reignition capacitor 472 is connected in parallel with the Zener diode 480.

The reignition DC reference voltage circuit 390 and the reignition DC comparison circuit 400 operate in the following manner. When the lamp load 70 is connected to terminals 420, 422, and 430, a reignition DC current is set up in the reignition circuit 140. The reignition DC current flows into the reignition charging circuit 470 and charges reignition capacitor 472. The DC reignition DC current also charges the differentiating capacitor 500 during this time as well. As a result, the charge stored on the differentiating capacitor 500 flows through differentiating resistor 510 to ground and generates a DC voltage spike, or pulse, across differentiating resistor 510. This DC voltage spike is the reignition control signal and can be used to cause the inverter microcontroller 110 to attempt to ignite the lamp load 70. Zener diode 480 is used to prevent excessive voltage across capacitor 472.

It is important to note that the reignition control signal is a spike or pulse of DC voltage and not a constant DC voltage. Once the lamp load 70 is connected the reignition circuit 140 generates this spike or pulse of voltage due to the voltage across a capacitor can not be changed instantaneously, i.e., jumps to a first predetermined DC voltage level high enough to trigger the inverter integrated chip, and then slowly drops down. The level of breakdown voltage of the clamping Zener diode can be varied from one application to another as long as it is chosen so that does not falsely trigger an ignition attempt by the inverter microcontroller 110.

The use of a spike or pulsed reignition control signal is significant because it prevents the reignition circuit 140 from generating ignition control signals that conflict with the control signals generated by the EOLL protection circuit 120 or other protection circuits in the ballast 10. As discussed in detail above, for instance, the EOLL protection circuit 120 is designed to generate an EOLL control signal when an end of lamp life condition occurs in the lamp load 70. This control signal causes the ballast to be shut down or placed in some other safe state so that the ballast 10 and the lamp load 70 are not damaged by the end of lamp life condition. Since all the filaments are present even when the ballast shuts down, the reignition capacitor will still be charged to some voltage level determined by the resistor divider. This voltage level will trigger the ballast to reignite after the EOLL control signal shuts down. It is possible, however, for the reignition circuit 140 to continue to generate a reignition DC current after the lamp load 70 has failed. This is true because the lamp filament used to form the reignition DC current path may be intact after such a failure. If the reignition control signal is a constant voltage, it may cause the inverter microcontroller 110 to attempt to ignite the lamp load 70 after the EOLL protection circuit 120 has shut down. This may also occur if the overheating protection circuit 130 places the ballast 10 in an overheating protected state. To avoid this problem, the present invention uses the spiked or pulsed voltage signal to ensure that the reignition control signal is generated only when the filament continuity is broken first and then resumed.

Figure 7:
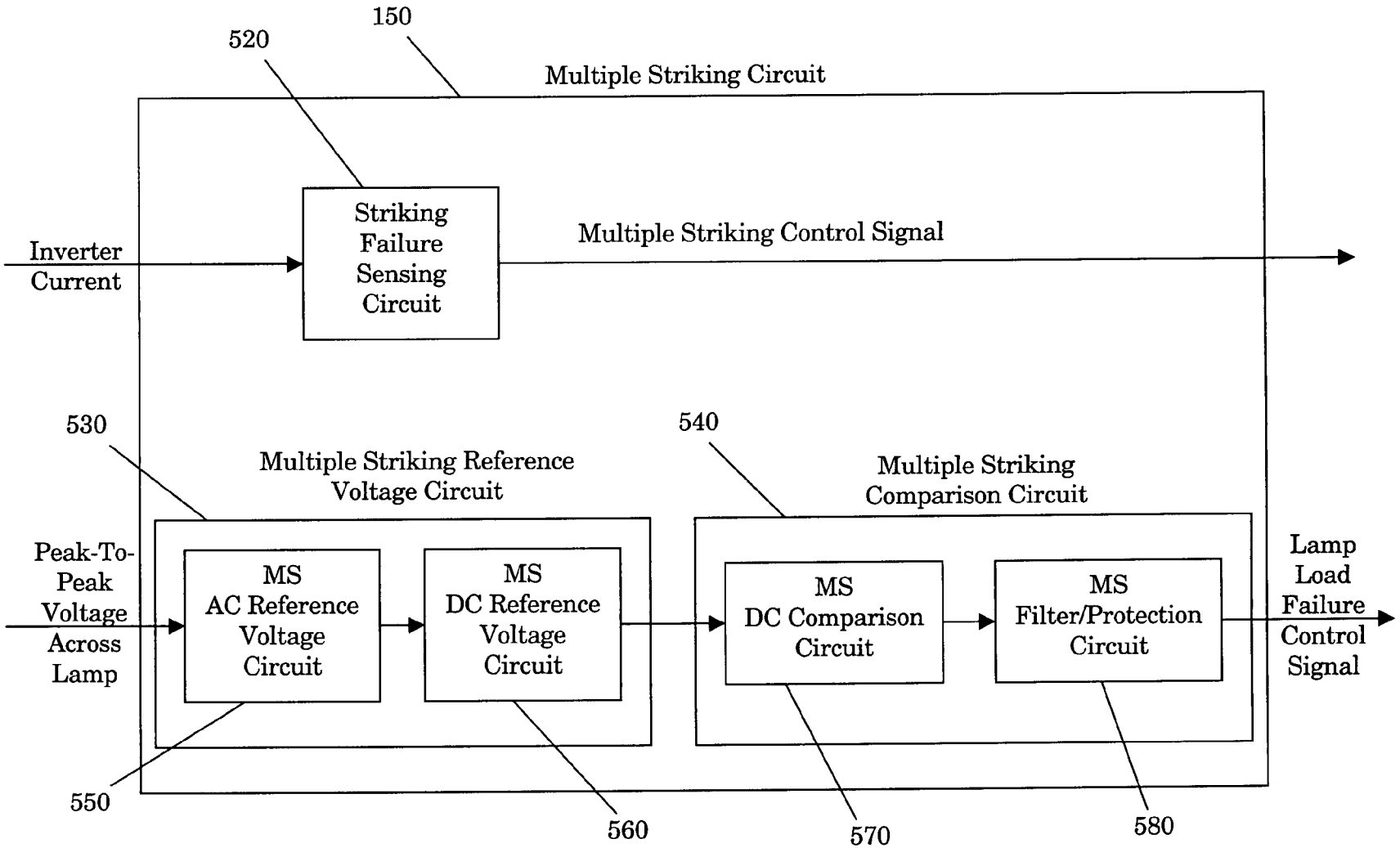
FIG. 7 is a block diagram of the multiple striking circuit of the present invention.
Figure 8I:
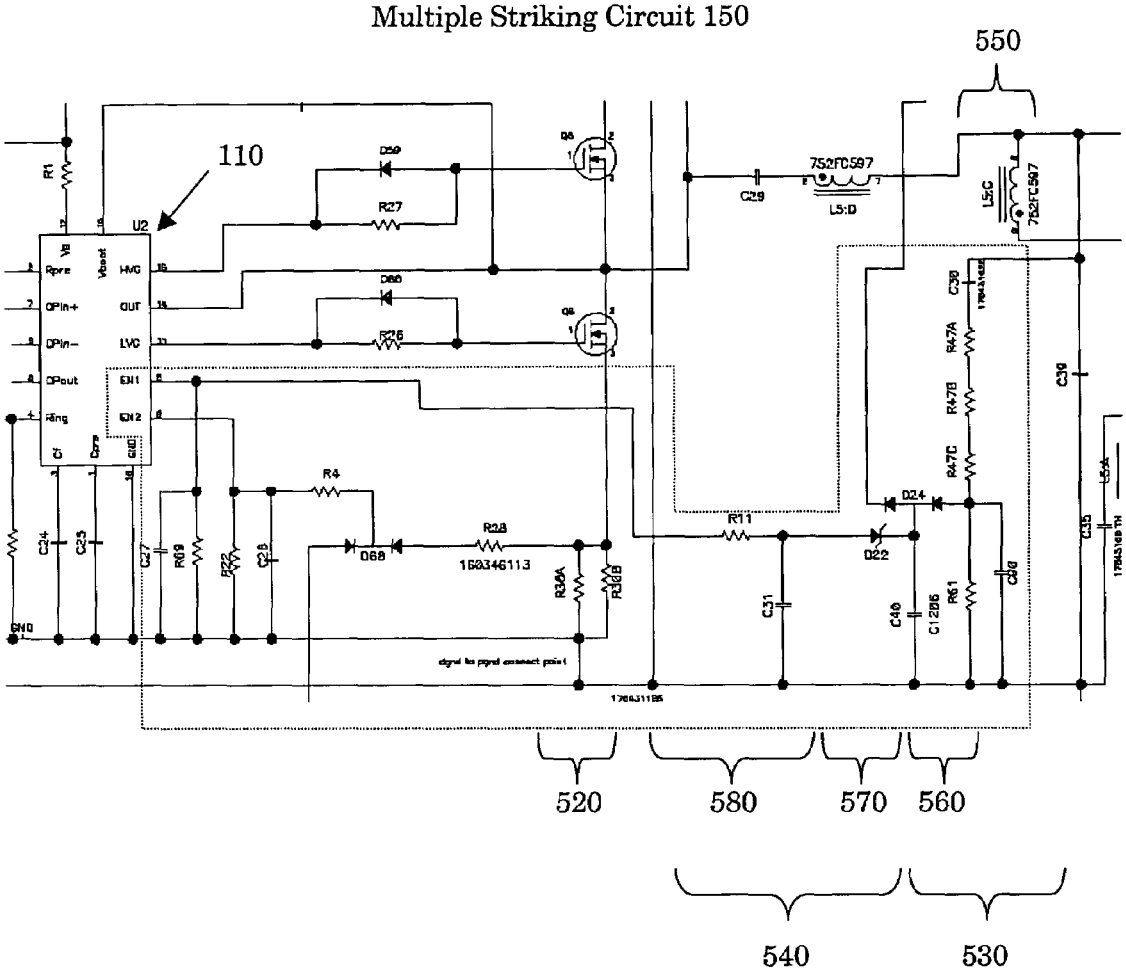

The multiple striking circuit 150, or multiple striking sensing and control circuit 150, (see FIGS. 7 and 8*i*) is operable to monitor the lighting process of the lamp load 70 by sensing the peak-to-peak lamp voltage across that load and to provide multiple striking control signals if the lamp load 70 fails to ignite. This control signal can then be used to cause the inverter microcontroller 110 to attempt to strike the lamp load 70 multiple times.

A multiple striking control signal is generated until the lamp ignites or a predetermined striking time limit is reached. If the time limit is reached, the multiple striking circuit 150 assumes that the lamp load 70 is bad, i.e., a lamp load that will not operate properly, and generates a lamp load failure control signal. (or simply a lamp failure control signal) that can be used to cause the ballast 10 to enter a lamp load failure protected state so that the ballast 10 and the lamp load 70 cannot be damaged by the failure of the lamp load. The lamp load failure state of the ballast 10 also prevents the ballast from generating continuous annoying reignition flashes.

In a preferred embodiment, the multiple striking circuit 150 (see FIGS. 7 and 8*i*) includes a striking failure sensing circuit 520, a multiple striking reference voltage circuit 530, and a multiple striking comparison circuit 540. The striking failure sensing circuit 520 is operable to sense when the lamp load 70 fails to ignite and, in response, generates multiple striking control signals. This control signal is then sent to the inverter microcontroller 110 (see FIG. 8) and used to generate multiple striking attempts. These striking attempts are applied to the lamp load 70 in an attempt to ignite the lamp load 70.

To determine if the lamp load 70 has ignited or failed to ignite, the striking failure sensing circuit 520 senses the current flowing through the inverter circuit 40. The striking failure sensing circuit 520 takes advantage of the fact that lamp starting voltage is much higher than normal operation voltage. This output voltage across the lamp load 10 is proportional to the current flowing through the inverter circuit 40. Thus this current varies a lot depending on whether or not the lamp load has ignited. When the lamp load 70 fails to ignite, the current at the striking flowing through the inverter circuit 40 is higher than it is when the lamp load 70 has been ignited to operate. When this current exceeds a predetermined striking reference current, the striking failure sensing circuit 520 assumes that the lamp load 70 has failed to ignite and generates a multiple striking control signal, which can be used to cause the inverter circuit 40 to restart and strike the lamp load. In a similar manner, if the current flowing through the inverter circuit 40 is below the predetermined striking reference current, the striking failure sensing circuit 520 assumes that the lamp load 70 has ignited and stops generating the multiple striking control signal.

To prevent the multiple striking circuit 150 from striking the lamp load indefinitely, the multiple striking circuit 150 senses the output voltage across the lamp load 70. For each strike the multiple striking charging capacitor will be charged to a higher level. After all the predetermined striking attempts, the voltage across the multiple striking charging capacitor will be higher than the multiple striking reference voltage and the Zener diode breaks down. Thus the lamp load failure control signal is generated. When it is higher than the enable reference voltage on the inverter driver integrated chip, then the ballast shuts down completely until cycling the power next time.

It is important to note that the multiple striking circuit 120 will also generate the multiple striking control signal when the lamp load 70 is removed from the ballast 10. Thus, the multiple striking control signal can also be used to shut down the ballast 10 eventually when the lamp load is disconnected from the ballast 10 after multiple striking attempts. When this occurs, the ballast 10 is referred to as being in a lamp disconnection state, or simply a disconnected protected state. Regardless of the description of this condition, the important point is that the ballast 10 is placed in a protected state so that it cannot harm customers when the lamp load 70 is disconnected from the ballast 10.

In the preferred embodiment, the multiple striking circuit 150 uses the same circuits that were used in the EOLL protection circuit 120 and the overheating protection circuit 130 discussed previously. Thus, the multiple striking circuit 150 includes a multiple striking reference voltage circuit 530, which includes a multiple striking AC reference voltage circuit 550 and a multiple striking DC reference voltage circuit 560, and a multiple striking comparison circuit 540, which includes a multiple striking DC comparison circuit 570 and a multiple striking filter/protection circuit 580. All of these circuits are identical to, and operate in a manner identical to, the circuits in the EOLL protection circuit 120 and the overheating protection circuit 130 discussed previously.

One skilled in the art will recognize that the EOLL control signal, the overheating control signal, and the lamp load failure control signal are the same signal in the preferred embodiment of the present invention. Once again, by integrating these circuits together, and their resulting control signals, the overall number of components required by, the cost of, and the complexity of, the ballast 10 of the present invention is reduced dramatically. In alternative embodiments, these circuits and control signals can be separated in to separate circuits and control signals.

FIG. 8 shows a more detailed schematic of the preferred embodiment of the ballast 10 of the present invention. The inverter microcontroller 110 is capable of driving the half bridge transistor circuit 90 and of receiving control signals from the various protection circuits included with the present invention. The inverter microcontroller 110 includes a shut-down pin (pin 8 labeled EN1), a reignition pin (pin 9 labeled EN2), a high voltage gate driver pin (pin 15 labeled HVG) for driving the high side transistor in half bridge transistor circuit 90, and a low voltage gate driver pin (pin 11 labeled LVG) for driving the low side transistor in half bridge transistor circuit 90. The shut-down pin is connected to the EOLL protection circuit 120, the overheating protection circuit 130, and the multiple striking circuit 150. The reignition pin is connected to the reignition circuit 140 and the multiple striking circuit 150. In a preferred embodiment, the inverter microcontroller 110 is the L6574-CFL/TL Ballast Driver Preheat and Dimming microcontroller manufactured and sold by ST Microelectronics. In alternative embodiments, various other microcontrollers may be used as well.

As shown in FIG. 8, the preferred embodiment also includes a variety of additional conventional circuit components that are well known in the art and will not be discussed in detail because they are not necessary for a proper understanding of the present invention. For example, the resistor/capacitor pairs connected to pins 8 and 9 of the inverter driver integrated chip 110 are used to filter noise out of the respective control signals applied to these pins. The resistor connected to pin 12 is used to prevent excessive current from entering the integrated chip 110 and the two resistors and capacitors connected to the left side and bottom of integrated chip 110 are used to set the preheating and operating frequencies for the inverter circuit 40 as is well known in the prior art. The diode connected to diode 280 (see FIG. 8*e*), the other half of the dual diode package 280, is used to quickly discharge rectifier circuit charging capacitor 272 after the ballast 10 has been shut down so that the ballast 10 may be quickly restarted if necessary. The resistors 411 (FIG. 8*g*) are used to supply power from the AC/DC rectifier circuit 20 to the inverter driver chip 110 in order to start up the chip 110.

In addition, FIGS. 8*a*–8*i* include dashed boxes showing the general areas where the EOLL protection, overheating protection, reignition, and multiple striking circuits are located. These dashed boxes are included for convenience and should not be interpreted to mean that a particular circuit must include all of the components included these dashed boxes. Because of the layout of the schematic shown in these figures, the dashed boxes may include some components that are not required by a particular circuit.

Thus, although there have been described particular embodiments of the present invention of a new and useful Electronic Ballast Having End Of Lamp Life, Overheating, and Shut Down Protections, And Reignition And Multiple Striking Capabilities, it is not intended that such references be construed as limitations upon the scope of this invention except as set forth in the following claims.

What is claimed is:

1. An electronic ballast protection and control circuit, comprising:

an end of lamp life sensing and control circuit adapted to sense an end of lamp life condition in a gas discharge lamp load connected to an electronic ballast and to cause the electronic ballast to enter an end of lamp life protected state when the end of lamp life condition occurs, wherein the end of lamp life sensing and control circuit is adapted to be capacitively coupled across an output of the electronic ballast, to sense the end of lamp life condition by sensing a peak-to-peak voltage that develops across the gas discharge lamp load when the end of lamp life condition occurs, to generate an end of lamp life control signal when the peak-to-peak voltage exceeds a predetermined end of lamp life reference voltage, and adapted to set the predetermined end of lamp life reference voltage using an end of lamp life reference component included in the end of lamp life sensing and control circuit, and wherein the end of lamp life sensing and control circuit is adapted to sense DC rectification and excessively high AC voltage end of lamp life conditions.

2. An electronic ballast protection and control circuit, comprising:

an end of lamp life sensing and control circuit adapted to sense an end of lamp life condition in a gas discharge lamp load connected to an electronic ballast and to cause the electronic ballast to enter an end of lamp life protected state when the end of lamp life condition occurs, wherein the end of lamp life sensing and control circuit is adapted to be capacitively coupled across an output of the electronic ballast, to sense the end of lamp life condition by sensing a peak-to-peak voltage that develops across the gas discharge lamp load when the end of lamp life condition occurs, to generate an end of lamp life control signal when the peak-to-peak voltage exceeds a predetermined end of lamp life reference voltage, and adapted to set the predetermined end of lamp life reference voltage using an end of lamp life reference component included in the end of lamp life sensing and control circuit, and wherein the end of lamp life sensing and control circuit is adapted to be connected in parallel with the gas discharge lamp load.

3. An electronic ballast protection and control circuit, comprising:

an end of lamp life sensing and control circuit adapted to sense an end of lamp life condition in a gas discharge lamp load connected to an electronic ballast and to cause the electronic ballast to enter an end of lamp life protected state when the end of lamp life condition occurs, wherein the end of lamp life sensing and control circuit is adapted to be capacitively coupled across an output of the electronic ballast, to sense the end of lamp life condition by sensing a peak-to-peak voltage that develops across the gas discharge lamp load when the end of lamp life condition occurs, to generate an end of lamp life control signal when the peak-to-peak voltage exceeds a predetermined end of lamp life reference voltage, and adapted to set the predetermined end of lamp life reference voltage using an end of lamp life reference component included in the end of lamp life sensing and control circuit, and wherein the end of lamp life sensing and control circuit is adapted so that current flowing through the sensing circuit is less than current flowing through the gas discharge lamp load.

4. An electronic ballast protection and control circuit, comprising:

an end of lamp life sensing and control circuit adapted to sense an end of lamp life condition in a gas discharge lamp load connected to an electronic ballast and to cause the electronic ballast to enter an end of lamp life protected state when the end of lamp life condition occurs, wherein the end of lamp life sensing and control circuit is adapted to be capacitively coupled across an output of the electronic ballast, to sense the end of lamp life condition by sensing a peak-to-peak voltage that develops across the gas discharge lamp load when the end of lamp life condition occurs, to generate an end of lamp life control signal when the peak-to-peak voltage exceeds a predetermined end of lamp life reference voltage, and adapted to set the predetermined end of lamp life reference voltage using an end of lamp life reference component included in the end of lamp life sensing and control circuit, and wherein the end of lamp life sensing and control circuit includes an AC sensing component adapted to sense AC voltage developed across the gas discharge lamp load.

5. An electronic ballast protection and control circuit, comprising:

an end of lamp life sensing and control circuit adapted to sense an end of lamp life condition in a gas discharge lamp load connected to an electronic ballast and to cause the electronic ballast to enter an end of lamp life protected state when the end of lamp life condition occurs, wherein the end of lamp life sensing and control circuit is adapted to be capacitively coupled across an output of the electronic ballast, to sense the end of lamp life condition by sensing a peak-to-peak voltage that develops across the gas discharge lamp load when the end of lamp life condition occurs, to generate an end of lamp life control signal when the peak-to-peak voltage exceeds a predetermined end of lamp life reference voltage, and adapted to set the predetermined end of lamp life reference voltage using an end of lamp life reference component included in the end of lamp life sensing and control circuit, and wherein the end of lamp life sensing and control circuit is further adapted to sense an overheating condition in the electronic ballast and to cause the electronic ballast to enter an overheating protected state when the overheating condition occurs.

6. A protection and control circuit for an electronic ballast, comprising:

an end of lamp life sensing and control circuit adapted to be capacitively coupled across an output of the electronic ballast, to sense an end of lamp life condition in a gas discharge lamp load connected to the electronic ballast and to cause the electronic ballast to enter an end of lamp life protected state when the end of lamp life condition occurs, wherein the end of lamp life sensing and control circuit is adapted to generate an end of lamp life control signal that is used to cause the electronic ballast to enter the end of lamp life protected state, wherein the end of lamp life sensing and control circuit is adapted to generate the end of lamp life control signal when a DC end of lamp life reference voltage generated by the end of lamp life sensing and control circuit exceeds a predetermined DC end of lamp life reference voltage, and wherein the end of lamp life sensing and control circuit is adapted to generate the DC end of lamp life reference voltage by generating an AC end of lamp life reference voltage representative of a peak-to-peak voltage across the gas discharge lamp load and converting the AC end of lamp life reference voltage into the DC end of lamp life reference voltage.

7. The protection and control circuit of claim 6, wherein the end of lamp life sensing and control circuit is adapted to generate the AC end of lamp life reference voltage by dividing the peak-to-peak voltage across the gas discharge lamp load using a voltage divider network.

8. The protection and control circuit of claim 6, wherein the end of lamp life sensing and control circuit is adapted to convert the AC end of lamp life reference voltage into the DC end of lamp life reference voltage by:

rectifying the AC end of lamp life reference voltage to generate an end of lamp life charging current; and charging a rectifier circuit capacitor using the end of lamp life charging current to generate the DC end of lamp life reference voltage.

9. A protection and control circuit for an electronic ballast, comprising:

an end of lamp life sensing and control circuit adapted to be capacitively coupled across an output of the electronic ballast, to sense an end of lamp life condition in a gas discharge lamp load connected to the electronic ballast and to cause the electronic ballast to enter an end of lamp life protected state when the end of lamp life condition occurs, wherein the end of lamp life sensing and control circuit is adapted to generate an end of lamp life control signal that is used to cause the electronic ballast to enter the end of lamp life protected state, wherein the end of lamp life sensing and control circuit is adapted to generate the end of lamp life control signal when a DC end of lamp life reference voltage generated by the end of lamp life sensing and control circuit exceeds a predetermined DC end of lamp life reference voltage, and wherein the end of lamp life sensing and control circuit is adapted to determine that the DC end of lamp life reference voltage exceeds the predetermined DC end of lamp life reference voltage by:

applying the DC end of lamp life reference voltage to an end of lamp life voltage controlled switch included in the end of lamp life sensing and control circuit; and wherein the end of lamp life voltage controlled switch includes an end of lamp life switching voltage that is equal to the predetermined DC end of lamp life reference voltage.

10. The protection and control circuit of claim 9, wherein the end of lamp life sensing and control circuit is adapted to generate the end of lamp life control signal when the end of lamp life switching voltage of the end of lamp life voltage controlled switch is exceeded by the DC end of lamp life reference voltage.

11. The protection and control circuit of claim 9, wherein the end of lamp life voltage controlled switch is a Zener diode.

* * * * *